US010412531B2

(12) United States Patent
Magariyachi et al.

(10) Patent No.: US 10,412,531 B2
(45) Date of Patent: Sep. 10, 2019

(54) AUDIO PROCESSING APPARATUS, METHOD, AND PROGRAM

(71) Applicant: Sony Corporation, Tokyo (JP)

(72) Inventors: Tetsu Magariyachi, Kanagawa (JP); Yuhki Mitsufuji, Tokyo (JP); Yu Maeno, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 16/066,772

(22) PCT Filed: Dec. 22, 2016

(86) PCT No.: PCT/JP2016/088379
§ 371 (c)(1),
(2) Date: Jun. 28, 2018

(87) PCT Pub. No.: WO2017/119318
PCT Pub. Date: Jul. 13, 2017

(65) Prior Publication Data

US 2019/0014433 A1 Jan. 10, 2019

(30) Foreign Application Priority Data

Jan. 8, 2016 (JP) ..... 2016-002167

(51) Int. Cl.
*H04S 7/00* (2006.01)
*H04S 3/00* (2006.01)
(Continued)

(52) U.S. Cl.
CPC ..... *H04S 7/304* (2013.01); *H04S 3/008* (2013.01); *H04R 5/033* (2013.01);
(Continued)

(58) Field of Classification Search
CPC . H04S 7/00; H04S 7/301; H04S 7/302; H04S 7/303; H04S 7/304; H04S 2420/00;
(Continued)

(56) References Cited

U.S. PATENT DOCUMENTS 6,215,879 B1 * 4/2001 Dempsey ..... H04S 1/007 381/61
7,231,054 B1 6/2007 Jot et al.
(Continued)

FOREIGN PATENT DOCUMENTS

EP 2268064 A1 12/2010
EP 2285139 A2 2/2011
(Continued)

OTHER PUBLICATIONS

International Search Report and English translation thereof dated Mar. 14, 2017 in connection with International Application No. PCT/JP2016/088379.
(Continued)

*Primary Examiner* — Thang V Tran
(74) *Attorney, Agent, or Firm* — Wolf, Greenfield & Sacks, P.C.

(57) ABSTRACT

The present technology relates to an audio processing apparatus, a method, and a program that aim at enabling a sound to be reproduced more efficiently. A head-related transfer function synthesis section previously holds a matrix of a diagonalized head-related transfer function. The head-related transfer function synthesis section synthesizes an input signal in an annular harmonic domain for reproducing a sound and the previously held and diagonalized head-related transfer function. An annular harmonic inverse transformation section performs an annular harmonic inverse transformation on a signal obtained as a result of the synthesis by the head-related transfer function synthesis section on the basis
(Continued)

of an annular harmonic function and thereby generates a headphone driving signal in a time frequency domain. The present technology is applicable to an audio processing apparatus.

12 Claims, 21 Drawing Sheets

(51) Int. Cl.
*H04R 3/00* (2006.01)
*H04R 5/00* (2006.01)
*H04R 5/033* (2006.01)

(52) U.S. Cl.
CPC ..... *H04S 2400/01* (2013.01); *H04S 2420/01* (2013.01); *H04S 2420/11* (2013.01)

(58) Field of Classification Search
CPC ..... H04S 2420/01; H04S 2420/11; H04S 2400/00; H04S 2400/01; H04S 2400/11; H04S 3/00; H04S 3/008; H04R 3/00; H04R 3/005; H04R 3/12; H04R 5/00; H04R 5/02; H04R 5/033; H04R 5/04; G06F 3/012
See application file for complete search history.

(56) References Cited

U.S. PATENT DOCUMENTS 9,495,968 B2 * 11/2016 Sen ..... G10L 19/20
10,009,704 B1 * 6/2018 Allen ..... H04S 3/004
2005/0147261 A1 * 7/2005 Yeh ..... H04M 3/567 381/92
2006/0045275 A1 3/2006 Daniel
2010/0329466 A1 12/2010 Berge
2014/0355795 A1 * 12/2014 Xiang ..... H04S 7/305 381/303
2015/0055783 A1 * 2/2015 Luo ..... H04S 5/00 381/17
2015/0294672 A1 10/2015 Batke et al.
2016/0255452 A1 * 9/2016 Nowak ..... G10L 19/008 381/17

FOREIGN PATENT DOCUMENTS

JP 2006-506918 A 2/2006
JP 2015-159598 A 9/2015
WO WO 2010/020788 A1 2/2010
WO WO 2011/117399 A1 9/2011

OTHER PUBLICATIONS

Daniel et al., Further Investigations of High Order Ambisonics and Wavefield Synthesis for Holophonic Sound Imaging, Audio Engineering Society, Convention Paper 5788, 114th Convention, Mar. 22-25, 2003, Amsterdam, The Netherlands, 18 pages.
Written Opinion and English translation thereof dated Mar. 14, 2017 in connection with International Application No. PCT/JP2016/088379.
International Preliminary Report on Patentability and English translation thereof dated Jul. 19, 2018 in connection with International Application No. PCT/JP2016/088379.
Extended European Search Report dated Nov. 23, 2018 in connection with European Application No. 16883817.5.
Jot et al., Binaural simulation of complex acoustic scenes for interactive audio. Audio Engineering Society. Convention Paper 6950. Presented at the 121st Convention Oct. 5-8, 2006 San Francisco, CA, USA. pp. 1-20.
Weller et al., Frequency dependent regularization of a mixed-order ambisonics encoding system using psychoacoustically motivated metrics. AES 55th International Conference, Helsinki, Finland Aug. 2014.

* cited by examiner

FIG. 11

| ORDER OF ANNULAR HARMONIC FUNCTION | 0 | 1 | 2 | 3 | 4 | 5 |
|---|---|---|---|---|---|---|
| REQUIRED NUMBER OF VIRTUAL SPEAKERS | 1 | 3 | 5 | 7 | 9 | 11 |
| OPERATION AMOUNT (GENERAL METHOD) | 3 | 15 | 35 | 63 | 99 | 143 |
| OPERATION AMOUNT (PROPOSED METHOD) | 4 | 12 | 20 | 28 | 36 | 44 |
| OPERATION AMOUNT (PROPOSED METHOD/ORDER -2) | 4 ** | 4 ** | 4 | 12 | 20 | 28 |
| MEMORY (GENERAL METHOD) | 20001 | 60009 | 100025 | 140049 | 180081 | 220121 |
| MEMORY (PROPOSED METHOD) | 300 | 900 | 1500 | 2100 | 2700 | 3300 |
| MEMORY (PROPOSED METHOD/ORDER -2) | 300 ** | 300 ** | 300 | 900 | 1500 | 2100 |

AUDIO PROCESSING APPARATUS, METHOD, AND PROGRAM

CROSS-REFERENCE TO RELATED APPLICATIONS

This application claims the benefit under 35 U.S.C. § 371 as a U.S. National Stage Entry of International Application No. PCT/JP2016/088379, filed in the Japanese Patent Office as a Receiving Office on Dec. 22, 2016, which claims priority to Japanese Patent Application Number JP2016-002167, filed in the Japanese Patent Office on Jan. 8, 2016, each of which is hereby incorporated by reference in its entirety.

TECHNICAL FIELD

The present technology relates to an audio processing apparatus, a method, and a program, and particularly to, an audio processing apparatus, a method, and a program that aim at enabling a sound to be reproduced more efficiently.

BACKGROUND ART

In recent years, in the field of sounds, a development or popularization of a system for recording, transmitting, and reproducing space information from the entire circumference has advanced. In a super high vision, for example, broadcasting has been programmed in a three-dimensional multi-channel acoustics of 22.2 channel.

Further, also in the field of virtual reality, a system that reproduces, in addition to a video surrounding the entire circumference, a signal surrounding the entire circumference with respect to sounds is getting out into the world.

An expression method regarding three-dimensional audio information that is able to flexibly respond to an arbitrary recording and reproducing system, which is called ambisonics in the above field, is used and noticed. In particular, the ambisonics in which an order is a second order or higher is called a higher order ambisonics (HOA) (for example, refer to NPL 1).

In the three-dimensional multi-channel acoustics, sound information spreads over a space axis in addition to a time axis. A frequency transformation is performed regarding an angular direction of three-dimensional polar coordinates in the ambisonics, that is, a spherical harmonic function transformation is performed to hold information. Further, when considering only a horizontal plane, an annular harmonic function transformation is performed. The spherical harmonic function transformation or the annular harmonic function transformation can be considered to correspond to a time frequency transformation to the time axis of an audio signal.

An effect of the above method lies in the fact that it is possible to encode and decode information from an arbitrary microphone array to an arbitrary speaker array without limiting the number of microphones or speakers.

On the one hand, as a factor in a hindrance to spreading the ambisonics, a speaker array including a large amount of speakers is required for a reproduction environment or a range (sweet spot) in which a sound space is reproducible is narrow.

For example, to raise a spatial resolution of sound, a speaker array including more speakers is required. However, it is unrealistic that such a system is built at home or the like. Further, an area capable of reproducing a sound space is narrow in a space as in a movie theater and it is difficult to give a desired effect to all spectators.

CITATION LIST

Non Patent Literature

[NPL 1]
Jerome Daniel, Rozenn Nicol, Sebastien Moreau, "Further Investigations of High Order Ambisonics and Wavefield Synthesis for Holophonic Sound Imaging," AES 114th Convention, Amsterdam, Netherlands, 2003.

SUMMARY

Technical Problem

To solve the above problem, ambisonics and a binaural reproduction technique are considered to be combined. The binaural reproduction technique is generally called a virtual auditory display (VAD) and is realized by using a head-related transfer function (HRTF).

Here, the HRTF expresses, as a function of a frequency and an arrival direction, information regarding how a sound is transmitted from every direction surrounding the head of a human being up to eardrums of both ears.

In a case in which a sound obtained by synthesizing the HRTF from a certain direction for a target sound is presented by headphones, a listener perceives as if a sound arrives not from the headphones but from a direction of the used HRTF. The VAD is a system using such a principle.

When a plurality of virtual speakers are reproduced by using the VAD, it is possible to realize, by presenting through headphones, the same effect as that of the ambisonics in a speaker array system including multiple speakers that is difficult actually.

However, such a system cannot reproduce a sound sufficiently efficiently. For example, in a case in which the ambisonics and the binaural reproduction technique are combined, not only a large amount of operation such as a convolution operation of the HRTF is performed but also a large amount of memory is used for the operation or the like.

The present technology has been made in view of the circumstances as described above and aims at enabling a sound to be reproduced more efficiently.

Solution to Problem

An audio processing apparatus according to one aspect of the present technology includes an HRTF synthesis section configured to synthesize an input signal in an annular harmonic domain or a portion of an input signal in a spherical harmonic domain corresponding to the annular harmonic domain and a diagonalized HRTF, and an annular harmonic inverse transformation section configured to perform an annular harmonic inverse transformation on a signal obtained by the synthesis on the basis of an annular harmonic function to thereby generate a headphone driving signal in a time frequency domain.

It is possible to cause the HRTF synthesis section to calculate a product of a diagonal matrix obtained by diagonalizing a matrix including a plurality of HRTFs by an annular harmonic function transformation and a vector including the input signal corresponding to each order of the annular harmonic function and thereby synthesize the input signal and the diagonalized HRTF.

It is possible to cause the HRTF synthesis section to synthesize the input signal and the diagonalized HRTF by using only an element of the predetermined order settable for each time frequency in a diagonal component of the diagonal matrix.

It is possible to cause the diagonalized HRTF used in common for users to be included as an element in the diagonal matrix.

It is possible to cause the diagonalized HRTF that depends on an individual user to be included as an element in the diagonal matrix.

It is possible to cause the audio processing apparatus to further include a matrix generation section configured to previously hold the diagonalized HRTF that is common to users, the diagonalized HRTF constituting the diagonal matrix, and acquire the diagonalized HRTF that depends on an individual user to generate the diagonal matrix from the acquired diagonalized HRTF and the previously held and diagonalized HRTF.

It is possible to cause the annular harmonic inverse transformation section to hold an annular harmonic function matrix including an annular harmonic function in each direction and perform the annular harmonic inverse transformation on the basis of a row corresponding to a predetermined direction of the annular harmonic function matrix.

It is possible to cause the audio processing apparatus to further include a head direction acquisition section configured to acquire a direction of the head of the user who listens to a sound based on the headphone driving signal, and it is possible to cause the annular harmonic inverse transformation section to perform the annular harmonic inverse transformation on the basis of a row corresponding to the direction of the head of the user in the annular harmonic function matrix.

It is possible to cause the audio processing apparatus to further include a head direction sensor section configured to detect a rotation of the head of the user, and it is possible to cause the head direction acquisition section to acquire a detection result by the head direction sensor section and thereby acquire the direction of the head of the user.

It is possible to cause the audio processing apparatus to further include a time frequency inverse transformation section configured to perform a time frequency inverse transformation on the headphone driving signal.

An audio processing method according to one aspect of the present technology includes the steps of: or a program according to one aspect of the present technology causes a computer to execute processing including the steps of: synthesizing an input signal in an annular harmonic domain or a portion of an input signal in a spherical harmonic domain corresponding to the annular harmonic domain and a diagonalized HRTF, and performing an annular harmonic inverse transformation on a signal obtained by the synthesis on the basis of an annular harmonic function to thereby generate a headphone driving signal in a time frequency domain.

In one aspect of the present technology, an input signal in an annular harmonic domain or a portion of an input signal in a spherical harmonic domain corresponding to the annular harmonic domain and a diagonalized HRTF are synthesized, and an annular harmonic inverse transformation is performed on a signal obtained by the synthesis on the basis of an annular harmonic function and thereby a headphone driving signal in a time frequency domain is generated.

Advantageous Effect of Invention

According to one aspect of the present technology, a sound can be reproduced more efficiently.

It is to be noted that the effect described here is not necessarily restrictive and may be any of effects described in the present disclosure.

BRIEF DESCRIPTION OF DRAWINGS

FIG. 11 is a diagram describing the operation amount and a required amount of memory of the proposed method and the general method.

DESCRIPTION OF EMBODIMENTS

Figure 1:
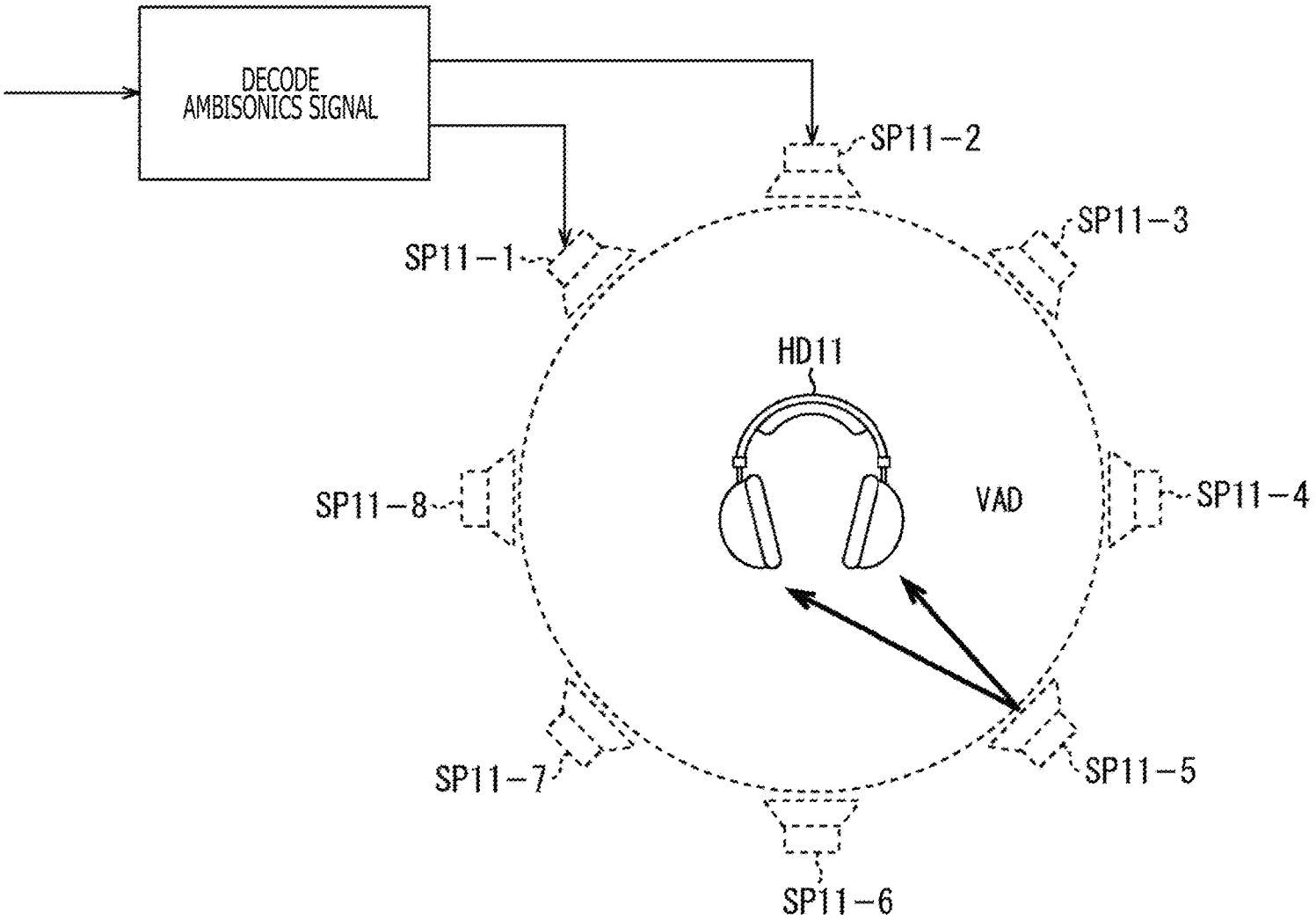
FIG. 1 is a diagram describing a simulation of a stereophonic sound using an HRTF.

Hereinafter, embodiments to which the present technology is applied will be described with reference to the accompanying drawings.

First Embodiment

<Present Technology>

In the present technology, an HRTF itself in a certain plane is considered to be a function of two-dimensional polar coordinates. In a similar manner, an annular harmonic function transformation is performed and a synthesis of an input signal and the HRTF is performed in an annular harmonic domain without decoding into a speaker array signal the input signal that is an audio signal in a spherical harmonic domain or the annular harmonic domain. This process permits a more efficient reproduction system to be realized from the viewpoint of an operation amount or a memory usage amount.

For example, a spherical harmonic function transformation to a function $f(\theta, \varphi)$ on spherical coordinates is represented by the following formula (1). Further, the annular harmonic function transformation to a function $f(\varphi)$ on two-dimensional polar coordinates is represented by the following formula (2).

[Math. 1]

$$F_n^m = \int_0^{\pi}\int_0^{2\pi} f(\theta,\phi)\overline{Y_n^m}(\theta,\phi)\,d\theta\,d\varphi \tag{1}$$

[Math. 2]

$$F^m = \int_0^{2\pi} f(\phi)\overline{Y^m}(\phi)\,d\phi \tag{2}$$

In formula (1), $\theta$ and $\varphi$ represent an elevation angle and a horizontal angle in the spherical coordinates, respectively, and $Y_n^m(\theta, \varphi)$ represents the spherical harmonic function. Further, a function in which "–" is given to an upper part of the spherical harmonic function $Y_n^m(\theta, \varphi)$ represents a complex conjugate of the spherical harmonic function $Y_n^m(\theta, \varphi)$.

Further, in formula (2), $\varphi$ represents a horizontal angle of the two-dimensional polar coordinates and $Y^m(\varphi)$ represents an annular harmonic function. A function in which "–" is given to an upper part of the annular harmonic function $Y^m(\varphi)$ represents a complex conjugate of the annular harmonic function $Y^m(\varphi)$.

Here, the spherical harmonic function $Y_n^m(\theta, \varphi)$ is represented by the following formula (3). Further, the annular harmonic function $Y^m(\varphi)$ is represented by the following formula (4).

[Math. 3]

$$Y_n^m(\theta, \phi) = (-1)^{(m+|m|)/2}\sqrt{\frac{2n+1(n-|m|)!}{4\pi(n+|m|)!}}\,P_n^{|m|}(\cos\theta)e^{jm\phi} \tag{3}$$

[Math. 4]

$$Y^m(\phi) = e^{jm\phi} \tag{4}$$

In formula (3), n and m represent an order of the spherical harmonic function $Y_n^m(\theta, \varphi)$ and $-n \le m \le n$ holds. Further, j represents a purely imaginary number and $P_n^m(x)$ is an associated Legendre function represented by the following formula (5). In a similar manner, in formula (4), m represents an order of the annular harmonic function $Y^m(\varphi)$ and j represents a purely imaginary number.

[Math. 5]

$$P_n^m(x) = \frac{1}{2^n n!}\frac{d^{n+m}}{dx^{n+m}}(x^2-1)^n \tag{5}$$

Further, an inverse transformation from a function $F_n^m$ subjected to the spherical harmonic function transformation to a function $f(\varphi)$ on the two-dimensional polar coordinates is represented by the following formula (6). Further, an inverse transformation from a function $F^m$ subjected to the annular harmonic function transformation to a function $f(\varphi)$ on the two-dimensional polar coordinates is represented by the following formula (7).

[Math. 6]

$$f(\phi) = \sum_{m=-\infty}^{m=\infty} F_{|m|}^m Y^m(\alpha_i) \tag{6}$$

[Math. 7]

$$f(\phi) = \sum_{m=-\infty}^{m=\infty} F^m Y^m(\phi) \tag{7}$$

As described above, a transformation from an input signal $D'^m_n(\omega)$ of a sound after a correction in a radial direction is performed to a speaker driving signal $S(x_i, \omega)$ of L respective speakers arranged on a circle having a radius R, which is held in the spherical harmonic domain, is represented by the following formula (8).

[Math. 8]

$$S(x_i, \omega) = \sum_{m=-\infty}^{m=\infty} D'^m_{|m|}(\omega)Y^m(\alpha_i) \tag{8}$$

Note that in formula (8), $x_i$ represents a position of the speaker and $\omega$ represents a time frequency of a sound signal. The input signal $D'^m_n(\omega)$ is an audio signal corresponding to each order n and each order m of the spherical harmonic function regarding a predetermined time frequency $\omega$ and only an element in which $|m|=n$ holds is used in the input signal $D'^m_n(\omega)$ in a calculation of formula (8). In other words, only a portion of the input signal $D'^m_n(\omega)$ corresponding to the annular harmonic domain is used.

Further, a transformation from an input signal $D'^m(\omega)$ of a sound after a correction in the radial direction is performed to the speaker driving signal $S(x_i, \omega)$ of L respective speakers arranged on a circle having a radius R, which is held in the annular harmonic domain, is represented by the following formula (9).

[Math. 9]

$$S(x_i, \omega) = \sum_{m=-\infty}^{m=\infty} D'^m(\omega)Y^m(\alpha_i) \tag{9}$$

Note that in formula (9), $x_i$ represents a position of a speaker and $\omega$ represents a time frequency of a sound signal. The input signal $D'^m(\omega)$ is an audio signal corresponding to each order m of the annular harmonic function regarding the predetermined time frequency $\omega$.

Further, the position $x_i$ in formulas (8) and (9) satisfies $x_i=(R\cos\alpha_i, R\sin\alpha_i)^t$ and i represents a speaker index for specifying a speaker. Here, i=1, 2, . . . , L holds and $\alpha_i$ represents a horizontal angle indicating a position of an i-th speaker.

A transformation represented by formulas (8) and (9) as described above is an annular harmonic inverse transformation corresponding to formulas (6) and (7). Further, in a case in which the speaker driving signal $S(x_i, \omega)$ is calculated by formulas (8) and (9), the number L of speakers that is the number of reproduction speakers and an order N of the annular harmonic function, that is, the maximum value N of an order m need to satisfy a relation represented by the following formula (10). Note that, subsequently, a case in which an input signal is a signal in the annular harmonic domain is described. Even if the input signal is a signal in the spherical harmonic domain, only the element in which |m|=n holds in the input signal $D'_n{}^m(\omega)$ is used, and thereby the same effects can be obtained by similar processing. In other words, the same discussions hold even in the input signal in the spherical harmonic domain as those in the input signal in the annular harmonic domain.

[Math. 10]

$$L>2N+1 \tag{10}$$

Incidentally, a general method as a method for simulating a stereophonic sound at ears by presenting through headphones is, for example, a method using the HRTF as illustrated in FIG. 1.

In an example illustrated in FIG. 1, an input ambisonics signal is decoded and respective speaker driving signals of a virtual speaker SP11-1 to a virtual speaker SP11-8 that are a plurality of virtual speakers are generated. At this time, the decoded signal corresponds to, for example, the above-described input signal $D'_n{}^m(\omega)$ or input signal $D'^m(\omega)$.

Here, the virtual speaker SP11-1 to the virtual speaker SP11-8 are annularly arrayed and virtually arranged, and a speaker driving signal of the respective virtual speakers is obtained by calculating the above-described formula (8) or (9). Note that hereinafter, in a case in which the virtual speaker SP11-1 to the virtual speaker SP11-8 need not be particularly discriminated, they are simply referred to as the virtual speakers SP11.

When the speaker driving signal of each of the virtual speakers SP11 is obtained in this manner, driving signals (binaural signals) of left and right of the headphones HD11 that actually reproduce a sound are generated by performing a convolution operation using the HRTF for each of the above virtual speakers SP11. Then, a sum of the driving signals of the headphones HD11 obtained in the respective virtual speakers SP11 is set to a final driving signal.

Meanwhile, such a method is written in detail in, for example, "ADVANCED SYSTEM OPTIONS FOR BINAURAL RENDERING OF AMBISONIC FORMAT (Gerald Enzner et. al. ICASSP 2013)" or the like.

The HRTF H(x, ω) used to generate the driving signals of left and right of the headphones HD11 is obtained by normalizing transfer characteristics $H_1(x, \omega)$ up to eardrum positions of a user who is a listener in a free space from a sound source position x in the state in which the head of the user is present by transfer characteristics $H_0(x, \omega)$ up to a center 0 of the head from the sound source position x in the state in which the head is not present. In other words, the HRTF H(x, ω) in the sound source position x is obtained by the following formula (11).

[Math. 11]

$$H(x, \omega) = \frac{H_1(x, \omega)}{H_0(x, \omega)} \tag{11}$$

Here, the HRTF H(x, ω) is convoluted on an arbitrary audio signal and is presented by using the headphones or the like. Through this process, an illusion as if a sound is heard from the direction of the convoluted HRTF H(x, ω), that is, from the direction of the sound source position x can be given to the listener.

In the example illustrated in FIG. 1, the driving signals of left and right of the headphones HD11 are generated by using such a principle.

Specifically, a position of each of the virtual speakers SP11 is set to a position $x_i$ and the speaker driving signal of the above virtual speakers SP11 is set to $S(x_i, \omega)$.

In addition, the number of the virtual speakers SP11 is set to L (here, L=8) and the final driving signals of left and right of the headphones HD11 are set to $P_l$ and $P_r$, respectively.

In this case, when the speaker driving signal $S(x_i, \omega)$ is simulated by presenting through the headphones HD11, the driving signal $P_l$ and the driving signal $P_r$ of left and right of the headphones HD11 can be obtained by calculating the following formula (12).

[Math. 12]

$$P_l = \sum_{i=1}^{L} S(x_i, \omega) H_l(x_i, \omega) \tag{12}$$

$$P_r = \sum_{i=1}^{L} S(x_i, \omega) H_r(x_i, \omega)$$

Note that in formula (12), $H_l(x_i, \omega)$ and $H_r(x_i, \omega)$ represent the normalized HRTFs up to the left and right eardrum positions of the listener from the position $x_i$ of the virtual speakers SP11, respectively.

The above operation enables the input signal $D'^m(\omega)$ in the annular harmonic domain to be finally reproduced by presenting through the headphones. In other words, the same effects as those of the ambisonics can be realized by presenting through the headphones.

As described above, an audio processing apparatus that generates the driving signal of left and right of the headphones from the input signal by using a general method (hereinafter, also referred to as a general method) for combining the ambisonics and the binaural reproduction technique has a configuration illustrated in FIG. 2.

Figure 2:
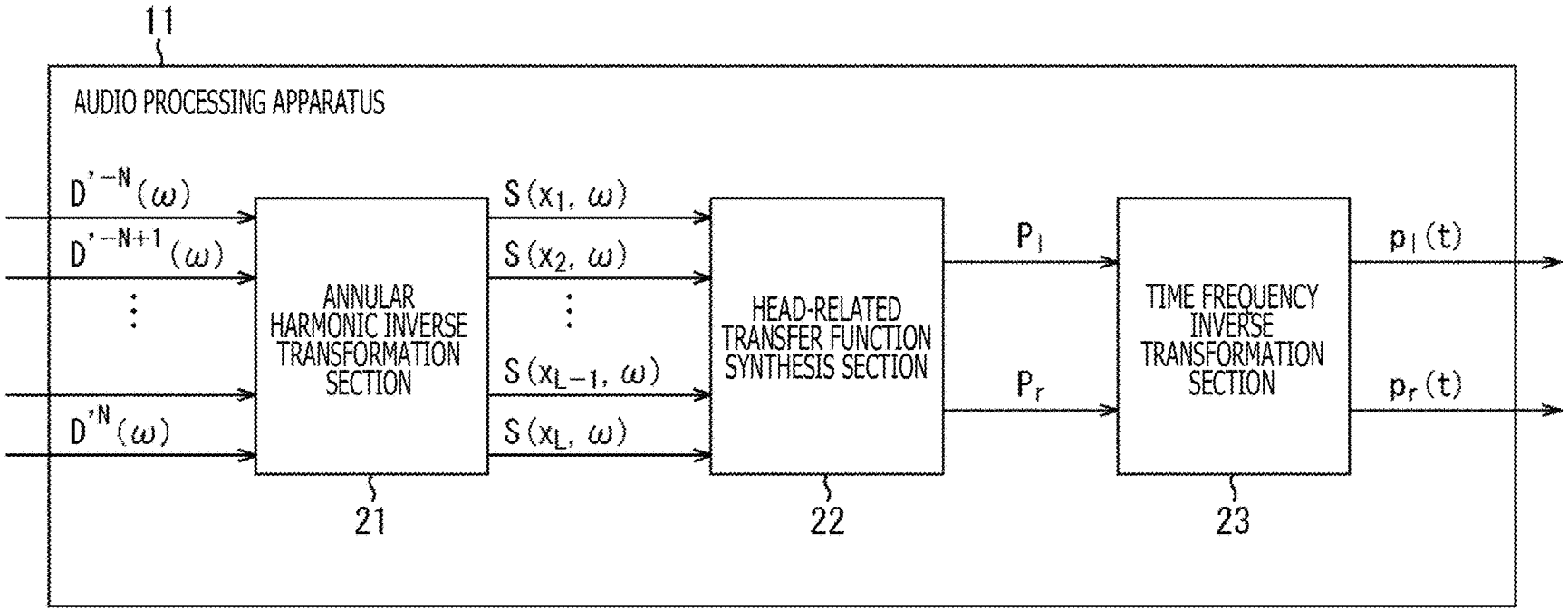
FIG. 2 is a diagram illustrating a configuration of a general audio processing apparatus.

Specifically, the audio processing apparatus 11 illustrated in FIG. 2 includes an annular harmonic inverse transformation section 21, an HRTF synthesis section 22, and a time frequency inverse transformation section 23.

The annular harmonic inverse transformation section 21 performs the annular harmonic inverse transformation on the input input signal $D'^m(\omega)$ by calculating formula (9). The speaker driving signal $S(x_i, \omega)$ of the virtual speakers SP11 obtained as a result is supplied to the HRTF synthesis section 22.

The HRTF synthesis section 22 generates and outputs the driving signal $P_l$ and the driving signal $P_r$ of left and right of the headphones HD11 by formula (12) on the basis of the speaker driving signal $S(x_i, \omega)$ from the annular harmonic inverse transformation section 21 and the previously prepared HRTF $H_l(x_i, \omega)$ and HRTF $H_r(x_i, \omega)$.

Further, the time frequency inverse transformation section 23 performs a time frequency inverse transformation on the driving signal $P_l$ and the driving signal $P_r$ that are signals in the time frequency domain output from the HRTF synthesis section 22. The driving signal $p_l(t)$ and the driving signal $p_r(t)$ that are signals in the time domain obtained as a result are supplied to the headphones HD11 to reproduce a sound.

Note that, hereinafter, in a case in which the driving signal $P_l$ and the driving signal $P_r$ regarding the time frequency ω need not be discriminated particularly, they are also referred to as a driving signal P(ω) simply. In a case in which the driving signal $p_l(t)$ and the driving signal $p_r(t)$ need not be discriminated particularly, they are also referred to as a driving signal p(t) simply. Further, in a case in which the HRTF $H_l(x_i, \omega)$ and the HRTF $H_r(x_i, \omega)$ need not be discriminated particularly, they are also referred to as an HRTF $H(x_i, \omega)$ simply.

Figure 3:
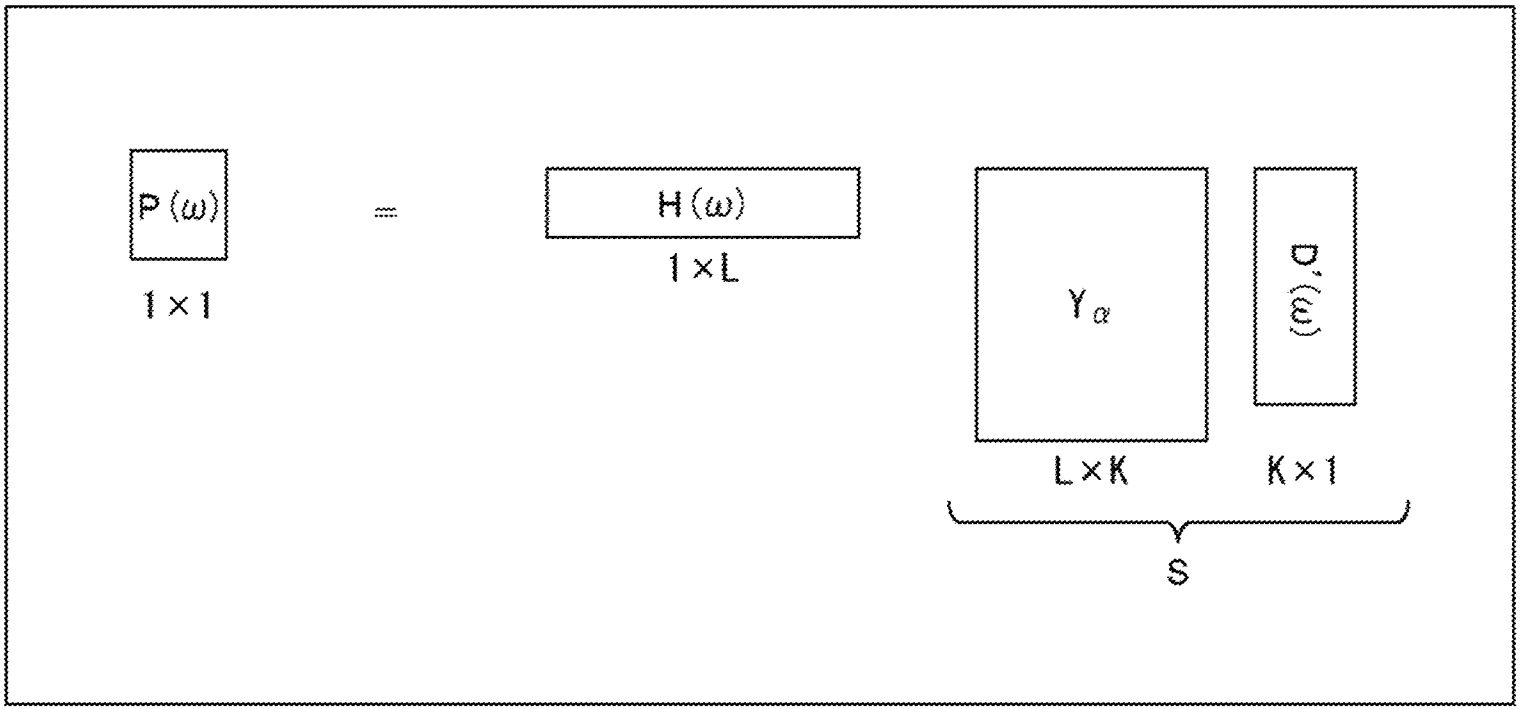
FIG. 3 is a diagram describing a calculation of a driving signal by a general method.

In the audio processing apparatus 11, for example, an operation illustrated in FIG. 3 is performed in order to obtain the driving signal P(ω) of 1×1, that is, one row one column.

In FIG. 3, H(ω) represents a vector (matrix) of 1×L including L HRTFs $H(x_i, \omega)$. Further, D'(ω) represents a vector including the input signal $D'^m(\omega)$ and when the number of the input signals $D'^m(\omega)$ of bin of the time frequency ω is K, the vector D'(ω) is K×1. Further, $Y_\alpha$ represents a matrix including the annular harmonic function $Y^m(\alpha_i)$ of each order and the matrix $Y_\alpha$ is a matrix of L×K.

Accordingly, in the audio processing apparatus 11, a matrix S obtained by performing a matrix operation of the matrix $Y_\alpha$ of L×K and the vector D'(ω) of K×1 is calculated. Further, a matrix operation of the matrix S and the vector (matrix) H(ω) of 1×L is performed and one driving signal P(ω) is obtained.

Further, in a case in which the head of the listener who wears the headphones HD11 is rotated in the direction of the predetermined direction $\varphi_j$ indicated by a horizontal angle of the two-dimensional polar coordinates, a driving signal $P_l(\varphi_j, \omega)$ of a left headphone of the headphones HD11 is, for example, represented by the following formula (13).

[Math. 13]

$$P_l(\phi_j, \omega) = \sum_{i=1}^{L} S(x_i, \omega) H(u(\phi_j)^{-1} x_i, \omega) \tag{13}$$

Meanwhile, in formula (13), the driving signal $P_l(\varphi_j, \omega)$ expresses the above-described driving signal $P_l$. Here, to clarify the position, that is, the direction $\varphi_j$ and the time frequency ω, the driving signal $P_l$ is described as the driving signal $P_l(\varphi_j, \omega)$. In addition, a matrix $u(\varphi_j)$ in formula (13) is a rotation matrix that performs a rotation by the angle $\varphi_j$. Accordingly, when the predetermined angle is, for example, $\varphi_j=\theta$, the matrix $u(\varphi_j)$, that is, the matrix u(θ) is a rotation matrix that rotates by an angle θ and is represented by the following formula (14).

[Math. 14]

$$u(\theta) = \begin{pmatrix} \cos\theta & -\sin\theta \\ \sin\theta & \cos\theta \end{pmatrix} \tag{14}$$

Figure 4:
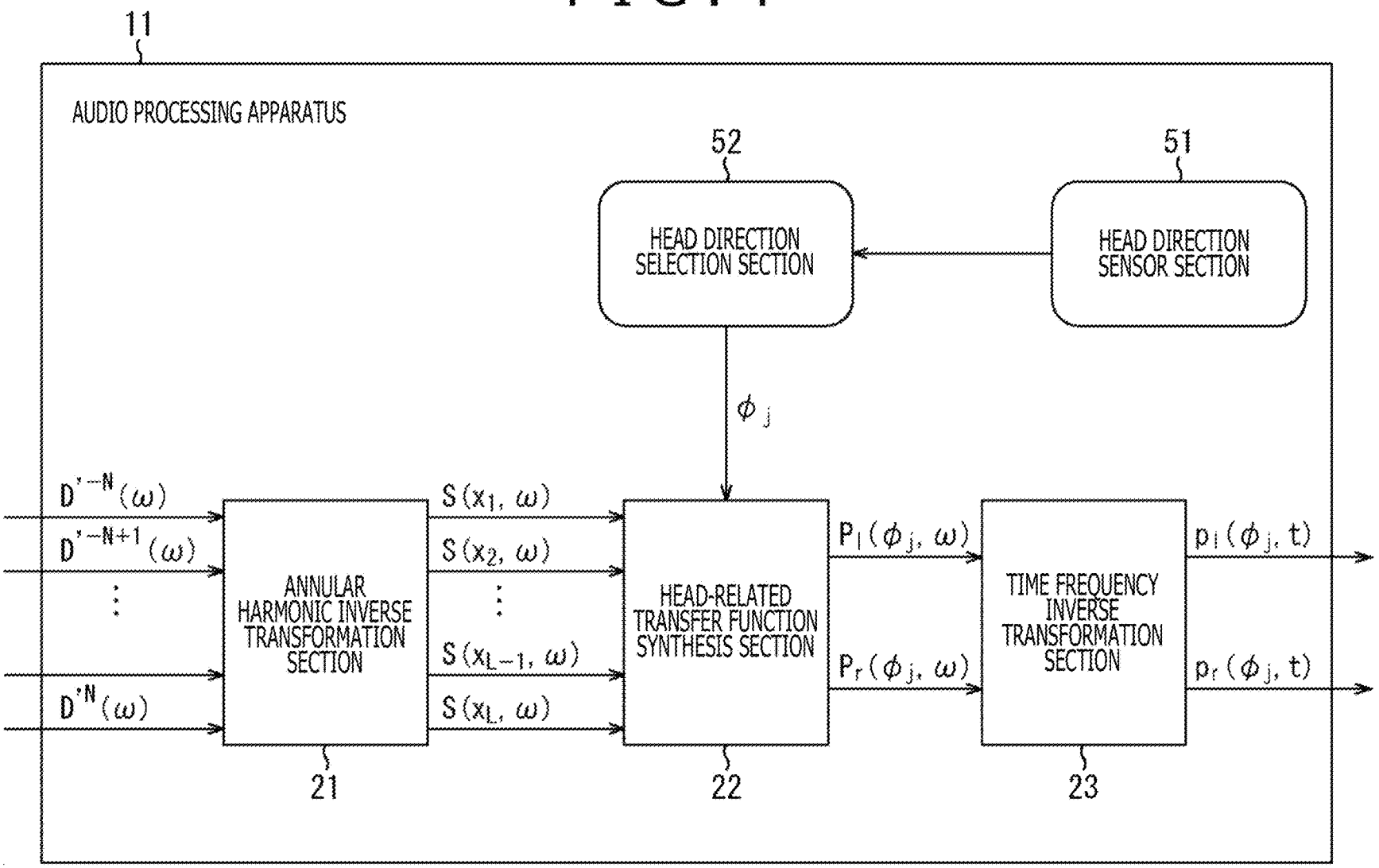
FIG. 4 is a diagram illustrating a configuration of an audio processing apparatus to which a head tracking function is added.

When a configuration for specifying a rotation direction of the head of the listener, that is, a configuration of a head tracking function is, for example, further added to the general audio processing apparatus 11 as illustrated in FIG. 4, a sound image position viewed from the listener can be fixed within a space. Note that in FIG. 4, the same sign as that of FIG. 2 is given to a portion corresponding to that of FIG. 2 and the descriptions are omitted arbitrarily.

In the audio processing apparatus 11 illustrated in FIG. 4, a head direction sensor section 51 and a head direction selection section 52 are further formed in the configuration illustrated in FIG. 2.

The head direction sensor section 51 detects a rotation of the head of the user who is the listener and supplies a detection result to the head direction selection section 52. The head direction selection section 52 calculates as the direction $\varphi_j$ the rotation direction of the head of the listener, that is, a direction of the head of the listener after the rotation on the basis of the detection result from the head direction sensor section 51 and supplies the direction $\varphi_j$ to the HRTF synthesis section 22.

In this case, on the basis of the direction $\varphi_j$ supplied by the head direction selection section 52, the HRTF synthesis section 22 calculates the driving signals of left and right of the headphones HD11 by using the HRTF of relative coordinates $u(\varphi_j)^{-1} x_i$ of each virtual speaker SP11 viewed from the head of the listener from among a plurality of previously prepared HRTFs. This process permits the sound image position viewed from the listener to be fixed within a space even in a case of reproducing a sound by the headphones HD11 similarly to a case of using an actual speaker.

When a driving signal of the headphones is generated by using the above-described general method or the method in which the head tracking function is further added to the general method, the same effects as those of the annularly arranged ambisonics can be obtained without using a speaker array and without limiting a range in which it is possible to reproduce a sound space. However, in the above methods, not only a large amount of operation such as the convolution operation of the HRTF is generated, but also a large amount of memory used for the operation or the like is generated.

To solve the above problem, in the present technology, the convolution operation of the HRTF, which is performed in the time frequency domain in the general method, is performed in the annular harmonic domain. Through this process, the operation amount of the convolution operation or a required amount of memory can be reduced and a sound can be reproduced more efficiently.

Hereinafter, a method according to the present technology will be described.

For example, when paying attention to the left headphone, the vector $P_l(\omega)$ including each of the driving signals $P_l(\varphi_j, \omega)$ of the left headphone in all rotational directions of the head of the user who is the listener is represented by the following formula (15).

[Math. 15]

$$\begin{aligned} P_l(\omega) &= H(\omega) S(\omega) \\ &= H(\omega) Y_\alpha D'(\omega) \end{aligned} \tag{15}$$

Note that in formula (15), S(ω) is a vector including the speaker driving signal $S(x_i, \omega)$ and $S(\omega)=Y_\alpha D'(\omega)$ holds. Further, in formula (15), $Y_\alpha$ represents a matrix including the annular harmonic function $Y^m(\alpha_i)$ of each order and an angle $\alpha_i$ of each virtual speaker, which is represented by the following formula (16). Here, i=1, 2, . . . , L holds and a maximum value of the order m (maximum order) is N.

D'(ω) represents a vector (matrix) including the input signal $D'^m(\omega)$ of a sound corresponding to each order, which is represented by the following formula (17). Each input signal $D'^m(\omega)$ is a signal in the annular harmonic domain.

Further, in formula (15), $H(\omega)$ represents a matrix including an HRTF $H(u(\varphi_j)^{-1} x_i, \omega)$ of the relative coordinates $u(\varphi_j)^{-1} x_i$ of each virtual speaker viewed from the head of the listener in a case in which a direction of the head of the listener is the direction $\varphi_j$, which is represented by the following formula (18). In this example, the HRTF $H(u(\varphi_j)^{-1} x_i, \omega)$ of each virtual speaker is prepared in M directions in total from the direction $\varphi_1$ to the direction $\varphi_M$.

[Math. 16]

$$Y_\alpha = \begin{pmatrix} Y^{-N}(\alpha_1) & \dots & Y^{N}(\alpha_1) \\ \vdots & \ddots & \vdots \\ Y^{-N}(\alpha_L) & \dots & Y^{N}(\alpha_L) \end{pmatrix} \tag{16}$$

[Math. 17]

$$D'\omega = \begin{pmatrix} D'^{-N}(\omega) \\ \vdots \\ D'^{N}(\omega) \end{pmatrix} \tag{17}$$

[Math. 18]

$$H(\omega) = \begin{pmatrix} H(u(\phi_1)^{-1}x_1, \omega) & \dots & H(u(\phi_1)^{-1}x_L, \omega) \\ \vdots & \ddots & \vdots \\ H(u(\phi_M)^{-1}x_1, \omega) & \dots & H(u(\phi_M)^{-1}x_L, \omega) \end{pmatrix} \tag{18}$$

When the driving signal $P_l(\varphi_j, \omega)$ of the left headphone at the time when the head of the listener is directed to the direction $\varphi_j$ is calculated, a row corresponding to the direction $\varphi_j$ that is a direction of the head of the listener, that is, a row of the HRTF $H(u(\varphi_j)^{-1} x_i, \omega)$ has only to be selected from the matrix $H(\omega)$ of the HRTF to calculate formula (15).

Figure 5:
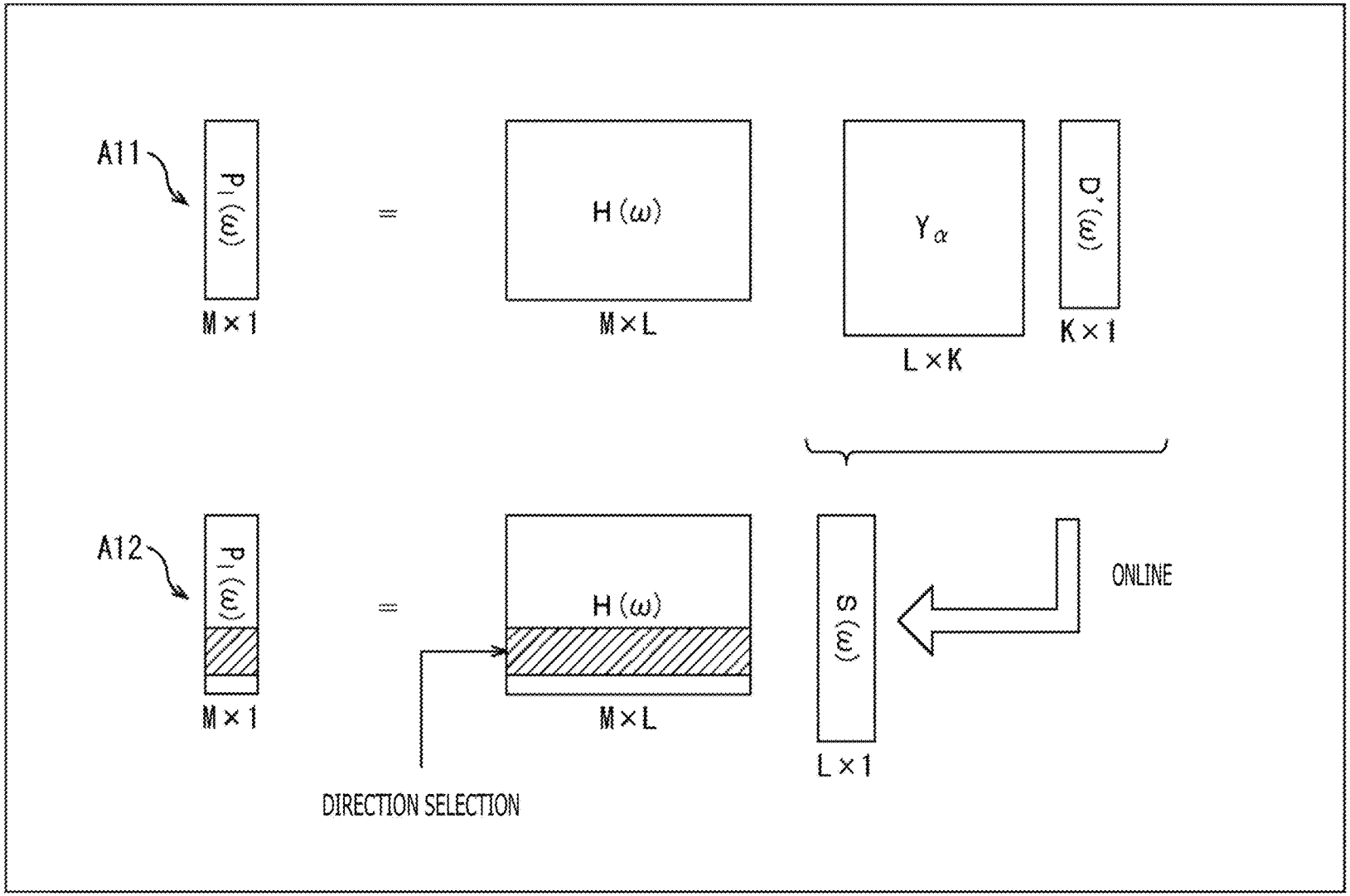
FIG. 5 is a diagram describing the calculation of the driving signal in a case of adding the head tracking function.

In this case, for example, calculation is performed only for a necessary row as illustrated in FIG. 5.

In this example, since HRTFs are prepared for M directions, the matrix calculation represented by formula (15) is as indicated with an arrow A11.

Specifically, when the number of the input signals $D'^m(\omega)$ of the time frequency $\omega$ is K, the vector $D'(\omega)$ is a matrix of K×1, that is, K rows one column. Further, the matrix $Y_\alpha$ of the annular harmonic function is L×K and the matrix $H(\omega)$ is M×L. Accordingly, in the calculation of formula (15), the vector $P_l(\omega)$ is M×1.

Here, when the matrix operation (product-sum operation) of the matrix $Y_\alpha$ and the vector $D'(\omega)$ is performed to calculate the vector $S(\omega)$, at the time of calculating the driving signal $P_l(\varphi_j, \omega)$, the row corresponding to the direction $\varphi_j$ of the head of the listener can be selected from the matrix $H(\omega)$ as indicated with an arrow A12 and an operation amount can be reduced. In FIG. 5, a shaded portion of the matrix $H(\omega)$ indicates the row corresponding to the direction $\varphi_j$, an operation of the row and the vector $S(\omega)$ is performed, and the desired driving signal $P_l(\varphi_j, \omega)$ of the left headphone is calculated.

Here, a matrix of M×K including the annular harmonic functions corresponding to the input signals $D'^m(\omega)$ in each of the M directions in total from the direction $\varphi_1$ to the direction $\varphi_M$ is assumed to be $Y_\varphi$. In other words, a matrix including the annular harmonic function $Y^m(\varphi_1)$ to the annular harmonic function $Y^m(\varphi_M)$ in the direction $\varphi_1$ to the direction $\varphi_M$ is assumed to be $Y_\varphi$. Further, an Hermitian transposed matrix of the matrix $Y_\varphi$ is assumed to be $V_\varphi^H$.

At this time, when the matrix $H'(\omega)$ is defined as indicated in the following formula (19), the vector $P_l(\omega)$ indicated in formula (15) can be represented by the following formula (20).

[Math. 19]

$$H'(\omega) = Y_\phi^H H(\omega) Y_\alpha \tag{19}$$

[Math. 20]

$$\begin{aligned} P_l(\omega) &= Y_\phi H'(\omega) D'(\omega) \\ &= Y_\phi B'(\omega) \end{aligned} \tag{20}$$

Note that the vector $B'(\omega)=H'(\omega)D'(\omega)$ holds in formula (20).

In formula (19), a calculation for diagonalizing the matrix $H(\omega)$ including the HRTF, in more detail, the HRTF in the time frequency domain is performed by the annular harmonic function transformation. Further, it is understood that in a calculation of formula (20), the convolution operation of the speaker driving signal and the HRTF is performed in the annular harmonic domain. Note that the matrix $H'(\omega)$ can be calculated and held previously.

Even in this case, when the driving signal $P_l(\varphi_j, \omega)$ of the left headphone at the time when the head of the listener is directed to the direction $\varphi_j$ is calculated, the row corresponding to the direction $\varphi_j$ of the head of the listener, that is, a row including the annular harmonic function $Y^m(\varphi_j)$ has only to be selected from the matrix $Y_\varphi$ of the annular harmonic function to calculate formula (20).

Here, when the matrix $H(\omega)$ can be diagonalized, that is, when the matrix $H(\omega)$ is sufficiently diagonalized by the above-described formula (19), at the time of calculating the driving signal $P_l(\varphi_j, \omega)$ of the left headphone, only a calculation indicated in the following formula (21) is performed. This process permits the operation amount and the required amount of memory to be reduced substantially. To be noted, hereinafter, assuming that the matrix $H(\omega)$ can be diagonalized and the matrix $H'(\omega)$ is a diagonal matrix, the descriptions are continued.

[Math. 21]

$$P_l(\phi_j, \omega) = \sum_{m=-N}^{N} Y^m(\phi_j) H'^m(\omega) D'^m(\omega) \tag{21}$$

In formula (21), $H'^m(\omega)$ represents one element of the matrix $H'(\omega)$ that is a diagonal matrix, that is, the HRTF in the annular harmonic domain that is a component (element) corresponding to the direction $\varphi_j$ of the head in the matrix $H'(\omega)$. m of the HRTF $H'^m(\omega)$ represents an order m of the annular harmonic function.

In a similar manner, $Y^m(\varphi_j)$ represents the annular harmonic function that is one element of the row corresponding to the direction $\varphi_j$ of the head in the matrix $Y_\varphi$.

Figure 6:
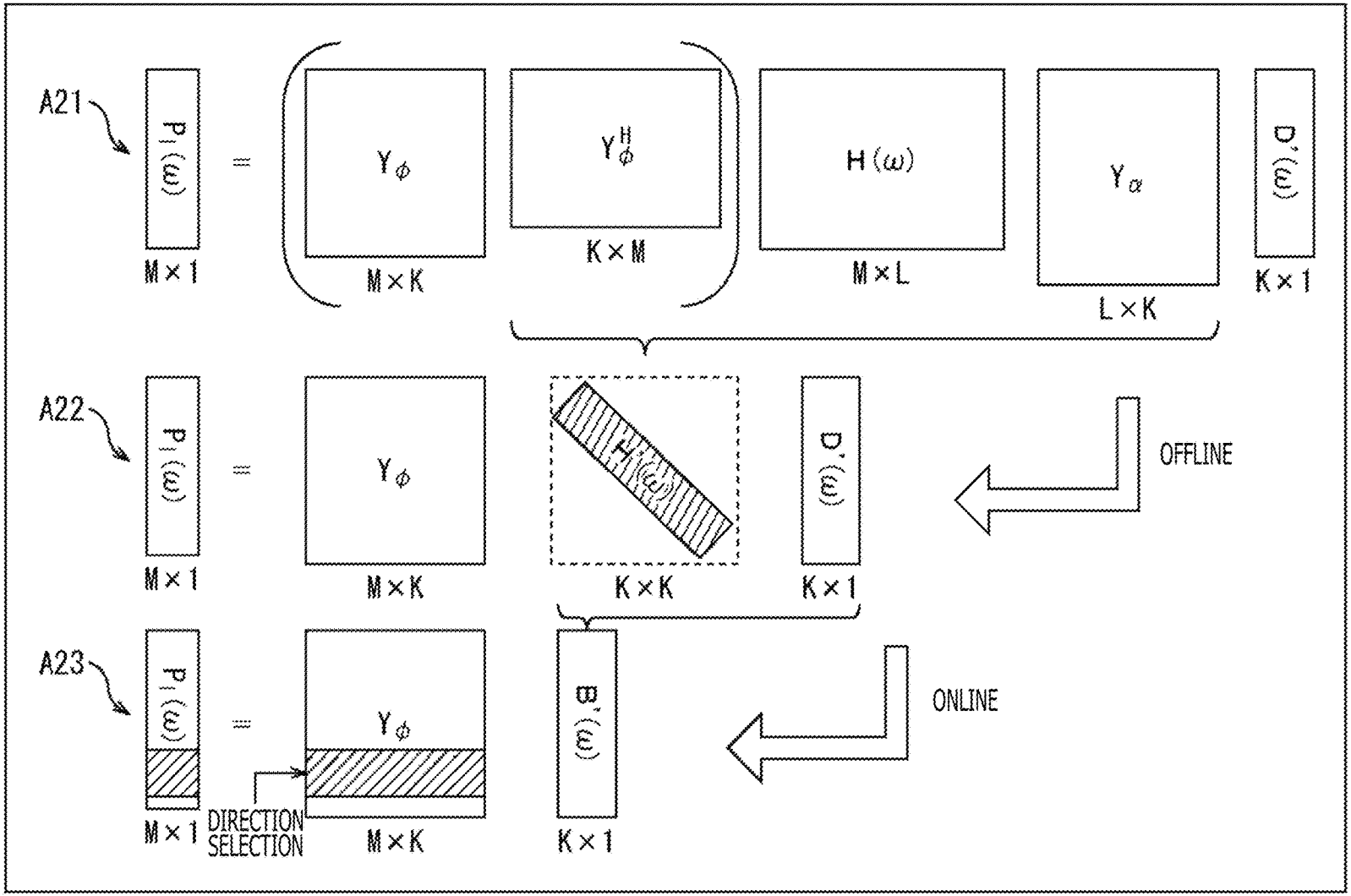
FIG. 6 is a diagram describing the calculation of the driving signal by a proposed method.

In the operation indicated in the above-described formula (21), the operation amount is reduced as illustrated in FIG. 6. In other words, the calculation illustrated in formula (20) is the matrix operation of the matrix $Y_\varphi$ of M×K, the matrix $Y_\varphi^H$ of K×M, the matrix $H(\omega)$ of M×L, the matrix $Y_\alpha$ of L×K, and the vector $D'(\omega)$ of K×1 as indicated with an arrow A21 of FIG. 6.

Here, $Y_\varphi^H H(\omega) Y_\alpha$ is the matrix H'(ω) as defined in formula (19), and therefore the calculation indicated with the arrow A21 is as indicated with an arrow A22 in the result. In particular, the calculation for obtaining the matrix H'(ω) can be performed offline, or previously. Therefore, when the matrix H'(ω) is previously obtained and held, the operation amount at the time of obtaining the driving signal of the headphones online can be reduced for the matrix H'(ω).

Further, in the calculation of formula (19), that is, in the calculation for obtaining the matrix H'(ω), the matrix H(ω) is diagonalized. Therefore, the matrix H'(ω) is a matrix of K×K as indicated with the arrow A22, but is substantially a matrix having only a diagonal component expressed by a shaded portion depending on the diagonalization. In other words, in the matrix H'(ω), values of elements other than the diagonal component are zero and the subsequent operation amount can be reduced substantially.

In a case in which the matrix H'(ω) is previously obtained in this manner, when the driving signal of the headphones is actually obtained, the calculation indicated with the arrow A22 and the arrow A23, that is, the calculation of the above-described formula (21) is performed.

Specifically, on the basis of the matrix H'(ω) and the vector D'(ω) including the input input signal $D'^m(\omega)$ as indicated with the arrow A22, the vector B'(ω) of K×1 is calculated online.

Then, the row corresponding to the direction $\varphi_j$ of the head of the listener is selected from the matrix $Y_\varphi$ as indicated with the arrow A23. The driving signal $P_l(\varphi_j, \omega)$ of the left headphone is calculated through the matrix operation of the selected row and the vector B'(ω). In FIG. 6, the shaded portion of the matrix $Y_\varphi$ expresses the row corresponding to the direction $\varphi_j$ and an element constituting the row is the annular harmonic function $Y^m(\varphi_j)$ represented by formula (21).

<Reduction in Operation Amount Etc. According to Present Technology>

Here, with reference to FIG. 7, with respect to the product-sum operation amount and the required amount of memory, a method (hereinafter, also referred to as a proposed method) according to the present technology described above and a method (hereinafter, also referred to as an extended method) in which the head tracking function is added to the general method are compared.

For example, when a length of the vector D'(ω) is set to K and the matrix H(ω) of the HRTF is set to M×L, the matrix $Y_\alpha$ of the annular harmonic function is L×K, the matrix $Y_\varphi$ is M×K, and the matrix H'(ω) is K×K.

Here, in the extended method, as indicated with an arrow A31 of FIG. 7, for bin of each time frequency ω (hereinafter, also referred to as a time frequency bin ω), the product-sum operation of L×K occurs in a process of transforming the vector D'(ω) to the time frequency domain and the product-sum operation occurs by 2 L by the convolution operation of the HRTFs of left and right.

Accordingly, a total of the number of times of the product-sum operation is (L×K+2 L) in a case of the extended method.

Figure 7:
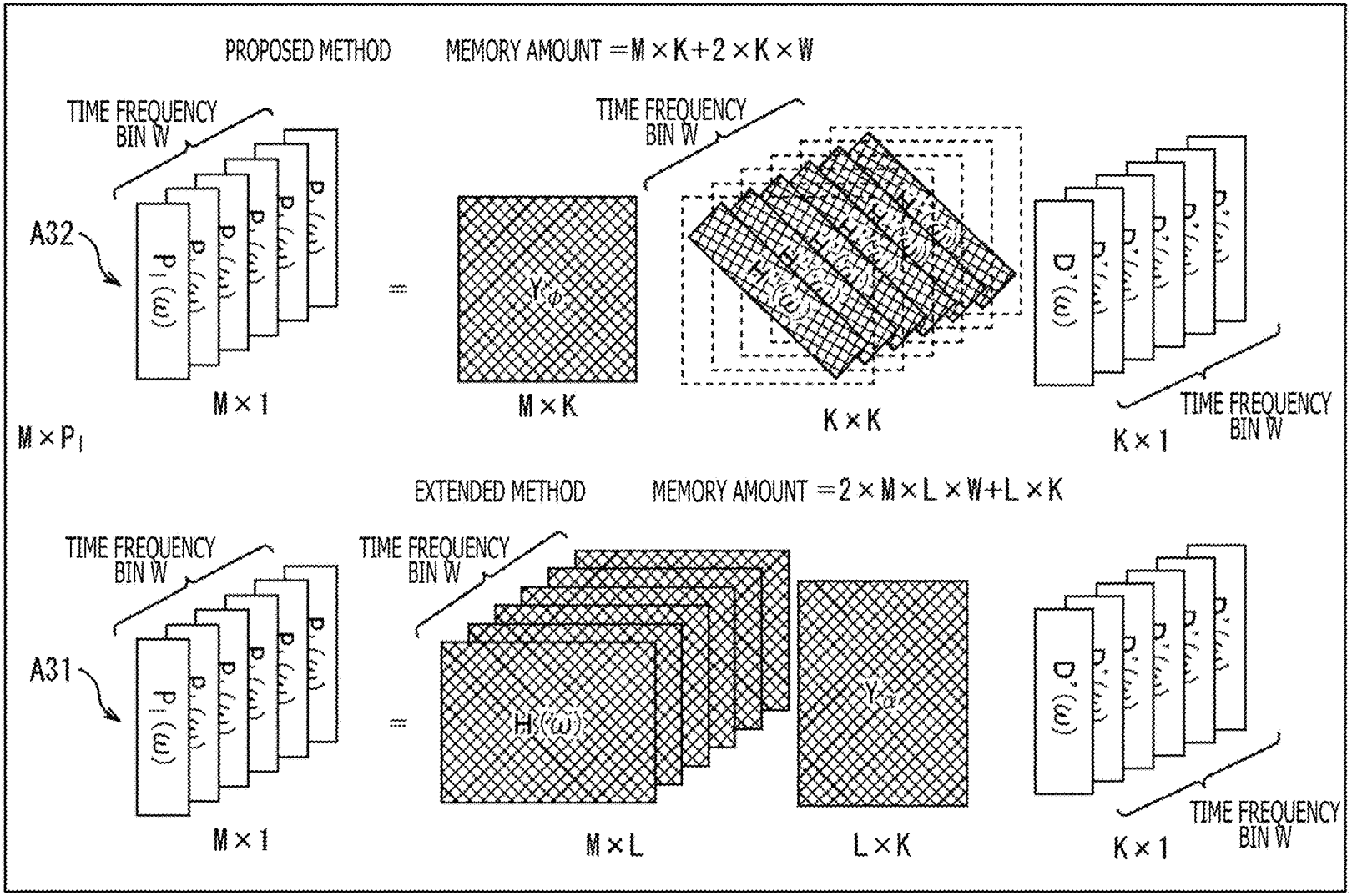
FIG. 7 is a diagram describing an operation at the time of calculating the driving signal by using the proposed method and an extended method.

Further, when each coefficient of the product-sum operation is one byte, the required amount of memory at the operation according to the extended method is (the number of directions of the held HRTF)×two bytes for each time frequency bin ω and the number of directions of the held HRTF is M×L as indicated with the arrow A31 of FIG. 7. Further, a memory is required by L×K bytes in the matrix $Y_\alpha$ of the annular harmonic function common to all the time frequency bins ω.

Accordingly, when the number of the time frequency bins ω is W, the required amount of memory according to the extended method is (2×M×L×W+L×K) bytes in total.

In contrast, in the proposed method, the operation indicated with an arrow A32 of FIG. 7 is performed for each time frequency bin ω.

Specifically, in the proposed method, for each time frequency bin ω, for one ear, the product-sum operation of K×K occurs in the convolution operation of the vector D (ω) in the annular harmonic domain and the matrix H'(ω) of the HRTF and further the product-sum operation occurs by K for a transformation to the time frequency domain.

Accordingly, a total of the number of times of the product-sum operation is (K×K+K)×2 in a case of the proposed method.

However, when the matrix H(ω) of the HRTF is diagonalized as described above, the product-sum operation is only K for one ear by the convolution operation of the vector D'(ω) and the matrix H'(ω) of the HRTF, and therefore a total of the number of times of the product-sum operation is 4K.

Further, the required amount of memory at the operation according to the proposed method is 2K bytes for each time frequency bin ω because only a diagonal component of the matrix H'(ω) of the HRTF is enough. Further, a memory is required by M×K bytes in the matrix $Y_\varphi$ of the annular harmonic function common to all the time frequency bins ω.

Accordingly, when the number of the time frequency bins ω is W, the required amount of memory according to the proposed method is (2×K×W+M×K) bytes in total.

Now, when the maximum order of the annular harmonic function is assumed to be 12, K=2×12+1=25 holds. In addition, the number L of the virtual speakers is required to be larger than K and therefore the number L is assumed to be L=32.

In such a case, the product-sum operation amount in the extended method is (L×K+2 L)=32×25+2×32=864. In contrast, the product-sum operation amount in the proposed method is 4K=25×4=100, and therefore it is understood that the operation amount is reduced substantially.

Further, for example, when W=100 and M=100 hold, the required amount of memory at the operation is (2×M×L×W+L×K)=2×100×32×100+32×25=640800 in the extended method. In contrast, the required amount of memory is (2×K×W+M×K)=2×25×100+100×25=7500 at the operation in the proposed method and it is understood that the required amount of memory is reduced substantially.

<Configuration Example of Audio Processing Apparatus>

Figure 8:
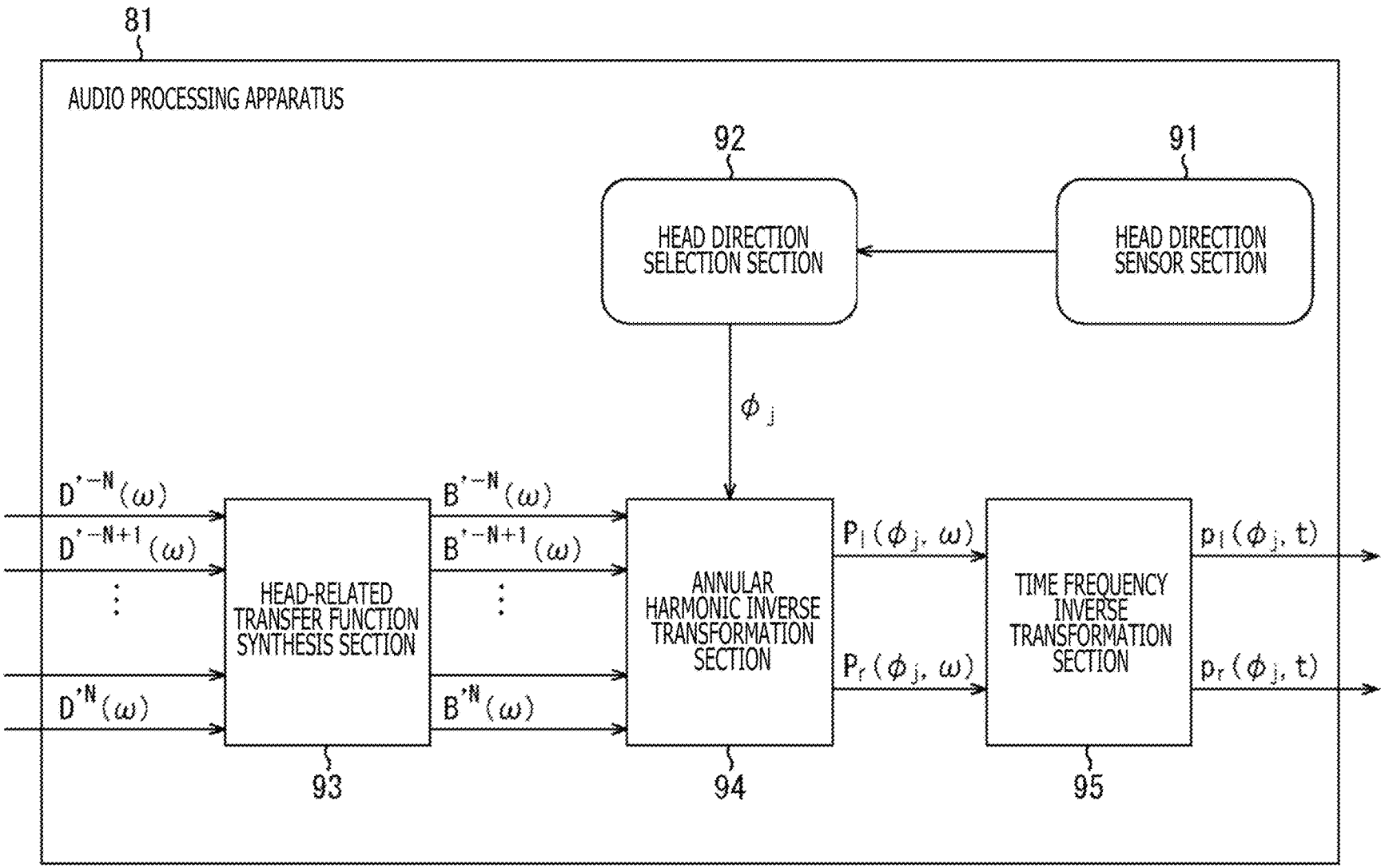
FIG. 8 is a diagram illustrating a configuration example of the audio processing apparatus to which the present technology is applied.

Next, the audio processing apparatus to which the present technology described above is applied will be described. FIG. 8 is a diagram illustrating a configuration example according to an embodiment of the audio processing apparatus to which the present technology is applied.

An audio processing apparatus 81 illustrated in FIG. 8 includes a head direction sensor section 91, a head direction selection section 92, an HRTF synthesis section 93, an annular harmonic inverse transformation section 94, and a time frequency inverse transformation section 95. Note that the audio processing apparatus 81 may be built in the headphones or be different from the headphones.

The head direction sensor section 91 includes, for example, an acceleration sensor, an image sensor, or the like attached to the head of the user as needed, detects a rotation (movement) of the head of the user who is the listener, and supplies the detection result to the head direction selection section 92. Note that, the term user here is a user who wears the headphones, that is, a user who listens to a sound reproduced by the headphones on the basis of the driving signal of the left and right headphones obtained by the time frequency inverse transformation section 95.

On the basis of the detection results from the head direction sensor section 91, the head direction selection section 92 obtains a rotation direction of the head of the listener, that is, the direction $\varphi_j$ of the head of the listener after the rotation and supplies the direction $\varphi_j$ to the annular harmonic inverse transformation section 94. In other words, the head direction selection section 92 acquires the detection result from the head direction sensor section 91, and thereby acquires the direction $\varphi_j$ of the head of the user.

To the HRTF synthesis section 93, the input signal $D'^m(\omega)$ of each order of the annular harmonic function regarding each time frequency bin $\omega$ that is an audio signal in the annular harmonic domain is supplied from the outside. Further, the HRTF synthesis section 93 holds the matrix $H'(\omega)$ including the HRTF previously obtained by the calculation.

The HRTF synthesis section 93 performs the convolution operation of the supplied input signal $D'^m(\omega)$ and the held matrix $H'(\omega)$, that is, a matrix of the HRTF diagonalized by the above-described formula (19). Thereby, the HRTF synthesis section 93 synthesizes the input signal $D'^m(\omega)$ and the HRTF in the annular harmonic domain and supplies the vector $B'(\omega)$ obtained as a result to the annular harmonic inverse transformation section 94. Note that hereinafter, an element of the vector $B'(\omega)$ is also described as $B'^m(\omega)$.

The annular harmonic inverse transformation section 94 previously holds the matrix $Y_\varphi$ including the annular harmonic function of each direction. From among rows constituting the matrix $Y_\varphi$, the annular harmonic inverse transformation section 94 selects the row corresponding to the direction $\varphi_j$ supplied by the head direction selection section 92, that is, a row including the annular harmonic function $Y^m(\varphi_j)$ of the above-described formula (21).

The annular harmonic inverse transformation section 94 calculates a sum of a product of the annular harmonic function $Y^m(\varphi_j)$ constituting a row of the matrix $Y_\varphi$ selected on the basis of the direction $\varphi_j$ and the element $B'^m(\omega)$ of the vector $B'(\omega)$ supplied by the HRTF synthesis section 93 and thereby performs the annular harmonic inverse transformation on an input signal in which the HRTF is synthesized.

Meanwhile, the convolution operation of the HRTF in the HRTF synthesis section 93 and the annular harmonic inverse transformation in the annular harmonic inverse transformation section 94 are performed in each of the left and right headphones. Through this process, in the annular harmonic inverse transformation section 94, the driving signal $P_l(\varphi_j, \omega)$ of the left headphone in the time frequency domain and the driving signal $P_r(\varphi_j, \omega)$ of the right headphone in the time frequency domain are obtained for each time frequency bin $\omega$.

The annular harmonic inverse transformation section 94 supplies the driving signal $P_l(\varphi_j, \omega)$ and the driving signal $P_r(\varphi_j, \omega)$ of the left and right headphones obtained by the annular harmonic inverse transformation to the time frequency inverse transformation section 95.

The time frequency inverse transformation section 95 performs the time frequency inverse transformation on the driving signal in the time frequency domain supplied by the annular harmonic inverse transformation section 94 for each of the left and right headphones. Thereby, the time frequency inverse transformation section 95 obtains the driving signal $p_l(\varphi_j, t)$ of the left headphone in the time domain and the driving signal $p_r(\varphi_j, t)$ of the right headphone in the time domain and outputs the above driving signals to the subsequent stage. In a reproduction apparatus that reproduces a sound in two channels, such as the headphones in the subsequent stage, in more detail, the headphones including earphones, a sound is reproduced on the basis of the driving signal output from the time frequency inverse transformation section 95.

<Description of Driving Signal Generation Processing>

Subsequently, driving signal generation processing performed by the audio processing apparatus 81 will be described with reference to a flowchart of FIG. 9. The driving signal generation processing is started when the input signal $D'^m(\omega)$ is supplied from the outside.

In step S11, the head direction sensor section 91 detects the rotation of the head of the user who is the listener and supplies the detection result to the head direction selection section 92.

In step S12, the head direction selection section 92 obtains the direction $\varphi_j$ of the head of the listener on the basis of the detection result from the head direction sensor section 91 and supplies the direction $\varphi_j$ to the annular harmonic inverse transformation section 94.

In step S13, the HRTF synthesis section 93 convolutes the HRTF $H'^m(\omega)$ constituting the previously held matrix $H'(\omega)$ to the supplied input signal $D'^m(\omega)$ and supplies the vector B (ω) obtained as a result to the annular harmonic inverse transformation section 94.

In step S13, in the annular harmonic domain, a calculation of a product of the matrix $H'(\omega)$ including the HRTF $H'^m(\omega)$ and the vector $D'(\omega)$ including the input signal $D'^m(\omega)$, that is, a calculation for obtaining $H'^m(\omega)D'^m(\omega)$ of the above-described formula (21) is performed.

In step S14, the annular harmonic inverse transformation section 94 performs the annular harmonic inverse transformation on the vector $B'(\omega)$ supplied by the HRTF synthesis section 93 and generates the driving signals of the left and right headphones on the basis of the previously held matrix $Y_\varphi$ and the direction $\varphi_j$ supplied by the head direction selection section 92.

Specifically, the annular harmonic inverse transformation section 94 selects the row corresponding to the direction $\varphi_j$ from the matrix $Y_\varphi$ and calculates formula (21) on the basis of the annular harmonic function $Y^m(\varphi_j)$ constituting the selected row and the element $B'^m(\omega)$ constituting the vector $B'(\omega)$ to thereby calculate the driving signal $P_l(\varphi_j, \omega)$ of the left headphone. In addition, the annular harmonic inverse transformation section 94 performs the operation on the right headphone similarly to a case of the left headphone and calculates the driving signal $P_r(\varphi_j, \omega)$ of the right headphone.

The annular harmonic inverse transformation section 94 supplies the driving signal $P_l(\varphi_j, \omega)$ and the driving signal $P_r(\varphi_j, \omega)$ of the left and right headphones obtained in this manner to the time frequency inverse transformation section 95.

In step S15, in each of the left and right headphones, the time frequency inverse transformation section 95 performs the time frequency inverse transformation on the driving signal in the time frequency domain supplied by the annular harmonic inverse transformation section 94 and calculates the driving signal $p_l(\varphi_j, t)$ of the left headphone and the driving signal $p_r(\varphi_j, t)$ of the right headphone. As the time frequency inverse transformation, for example, an inverse discrete Fourier transformation is performed.

The time frequency inverse transformation section 95 outputs the driving signal $p_l(\varphi_j, t)$ and the driving signal $p_r(\varphi_j, t)$ in the time domain obtained in this manner to the left and right headphones, and the driving signal generation processing ends.

As described above, the audio processing apparatus 81 convolutes the HRTF to the input signal in the annular harmonic domain and performs the annular harmonic inverse transformation on the convolution result to calculate the driving signals of the left and right headphones.

In this manner, the convolution operation of the HRTF is performed in the annular harmonic domain and thereby the operation amount at the time of generating the driving signals of the headphones can be reduced substantially. At the same time, the required amount of memory at the operation can also be reduced substantially. In other words, a sound can be reproduced more efficiently.

Modification Example 1 of First Embodiment

<Cutoff of Order for Each Time Frequency>

Incidentally, it is understood that the HRTF $H(u(\varphi_j)^{-1} x_i, \omega)$ constituting the matrix $H(\omega)$ varies in a necessary order in the annular harmonic domain. The above fact is written, for example, in "Efficient Real Spherical Harmonic Representation of Head-Related Transfer Functions (Griffin D. Romigh et. al., 2015)" or the like.

For example, among diagonal components of the matrix $H'(\omega)$ of the HRTF, if the necessary order $m=N(\omega)$ is understood in each time frequency bin $\omega$, the operation amount can be reduced by, for example, obtaining the driving signal $P_l(\varphi_j, \omega)$ of the left headphone by the calculation of the following formula (22). The right headphone is similar to the left headphone in the above matter.

[Math. 22]

$$P_l(\phi_j, \omega) = \sum_{m=-N(\omega)}^{N(\omega)} Y^m(\phi_j) H'^m(\omega) D'^m(\omega) \tag{22}$$

The calculation of formula (22) is basically the same as that of formula (21). However, both are different in that with respect to a range of an addition object according to $\Sigma$, the order $m=-N$ to $N$ holds in formula (21) while the order $m=-N(\omega)$ to $N(\omega)$ $(N \geq N(\omega))$ holds in formula (22).

Figure 10:
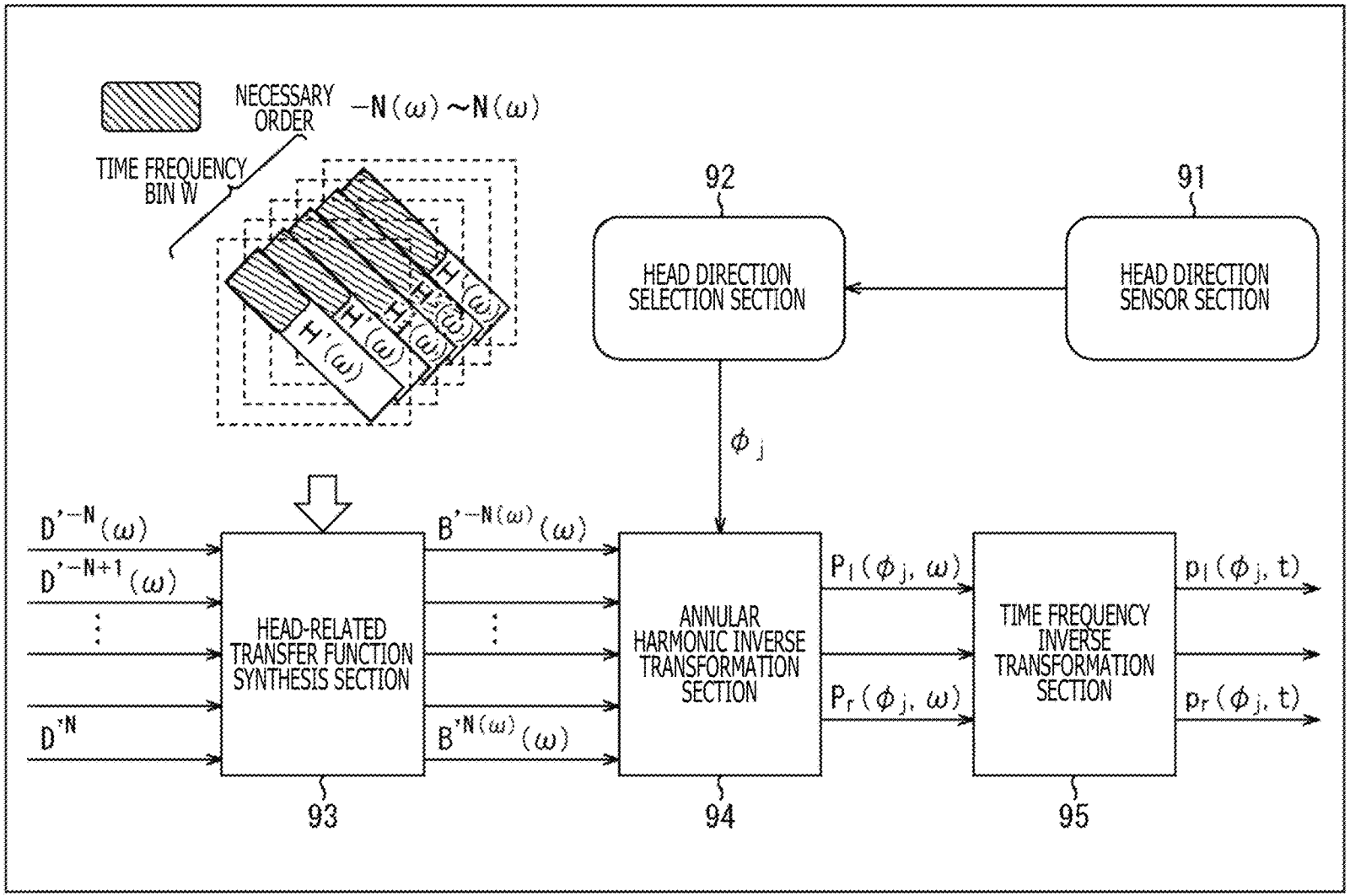
FIG. 10 is a diagram describing a reduction in an operation amount by a cutoff of an order.

In this case, for example, in the HRTF synthesis section 93 as illustrated in FIG. 10, only a portion of the diagonal components of the matrix $H'(\omega)$, that is, only each element of the order $m=-N(\omega)$ to $N(\omega)$ is used in the convolution operation. Note that in FIG. 10, the same sign as that of FIG. 8 is given to a portion corresponding to that of FIG. 8 and the descriptions are omitted arbitrarily.

In FIG. 10, a rectangle in which a character "$H'(\omega)$" is written represents the diagonal component of the matrix $H'(\omega)$ of each time frequency bin $\omega$ held by the HRTF synthesis section 93. A shaded portion of the diagonal components represents an element part of the necessary order m, that is, the order $-N(\omega)$ to the order $N(\omega)$.

Figure 9:
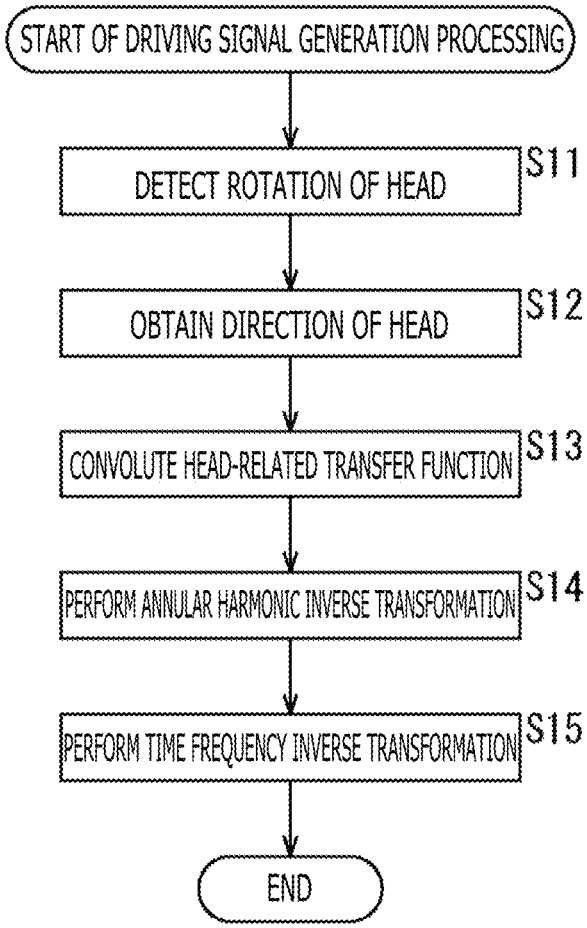
FIG. 9 is a flowchart describing driving signal generation processing.

In such a case, in step S13 and step S14 of FIG. 9, the convolution operation of the HRTF and the annular harmonic inverse transformation are performed in accordance with not the calculation of formula (21) but the calculation of formula (22).

In this manner, the convolution operation is performed by using only components (elements) of the necessary orders in the matrix $H'(\omega)$ and the convolution operation is not performed by using the components of the other orders. This process permits the operation amount and the required amount of memory to be further reduced. Note that the necessary order in the matrix $H'(\omega)$ can be set for each time frequency bin $\omega$. In other words, the necessary order in the matrix $H'(\omega)$ may be set for each time frequency bin $\omega$ or a common order may be set as the necessary order for all the time frequency bins $\omega$.

Here, the operation amount and the required amount of memory in cases of performing the general method, the above-described proposed method, and further the operation using only the component of the necessary order m by the proposed method are illustrated in FIG. 11.

In FIG. 11, a column of the "Order of annular harmonic function" represents a value of the maximum order $|m|=N$ of the annular harmonic function and a column of the "Required number of virtual speakers" represents the minimum number of the virtual speakers required to correctly reproduce a sound field.

In addition, a column of the "Operation amount (general method)" represents the number of times of the product-sum operation required to generate the driving signal of the headphones by the general method. A column of the "Operation amount (proposed method)" represents the number of times of the product-sum operation required to generate the driving signal of the headphones by the proposed method.

Further, a column of the "operation amount (proposed method/order −2)" represents the number of times of the product-sum operation required to generate the driving signal of the headphones in accordance with the operation using the proposed method and the orders up to the order $N(\omega)$. The above example is an example in which a higher first order and second order of the order m are particularly cut off and not operated.

Here, in the column of each operation amount in a case of performing the general method, the proposed method, and the operation using the orders up to the order $N(\omega)$ by the proposed method, the number of times of the product-sum operation for each time frequency bin $\omega$ is written.

Further, a column of the "Memory (general method)" represents the memory amount required to generate the driving signal of the headphones by using the general method. A column of the "Memory (proposed method)" represents the memory amount required to generate the driving signal of the headphones by using the proposed method.

Further, a column of the "Memory (proposed method/order −2)" represents the memory amount required to generate the driving signal of the headphones by the operation using the orders up to the order $N(\omega)$ by the proposed method. The above example is an example in which a higher first order and second order of the order $|m|$ are particularly cut off and not operated.

Note that a column in which a sign "" is written in FIG. 11** represents that since the order −2 is negative, the calculation is performed with the order N=0.

In an example illustrated in FIG. 11, for example, when taking notice of a column of the operation amount in the order N=4, the operation amount is 36 in the proposed method. In contrast, in a case in which the order N=4 holds and the order necessary for a certain time frequency bin $\omega$ is $N(\omega)=2$, when the orders up to the order $N(\omega)$ are used for the calculation by the proposed method, the operation amount is $4K=4(2\times2+1)=20$. Accordingly, it is understood that the operation amount can be reduced to 55% as compared to a case in which the original order N is 4.

Second Embodiment

<Reduction in Required Amount of Memory Regarding HRTF>

Incidentally, the HRTF is a filter formed through diffraction or reflection of the head, the auricles, or the like of the listener, and therefore the HRTF is different depending on an individual listener. Therefore, an optimization of the HRTF to the individual is important for the binaural reproduction.

However, from the viewpoint of the memory amount, it is not appropriate to hold the HRTFs of the individuals in number corresponding to the listeners assumed. The above fact is applicable to even a case in which the HRTF is held in the annular harmonic domain.

In a case in which the HRTF optimized to the individual is assumed to be used in the reproduction system to which the proposed method is applied, if the order that does not depend on the individual and the order that depends on the individual are previously specified for each time frequency bin ω or all the time frequency bins ω, the number of necessary individual dependence parameters can be reduced. Further, on the occasion when the HRTF of the individual listener is estimated on the basis of a body shape or the like, it is considered that an individual dependence coefficient (HRTF) in the annular harmonic domain is set as an objective variable.

Here, the order that depends on the individual is the order m that is largely different in transfer characteristics for each individual user, that is, the order m that is different in the HRTF $H'^{m}(\omega)$ for each user.

In contrast, the order that does not depend on the individual is the order m of the HRTF $H'^{m}(\omega)$ in which a difference in transfer characteristics among individuals is sufficiently small.

Figure 12:
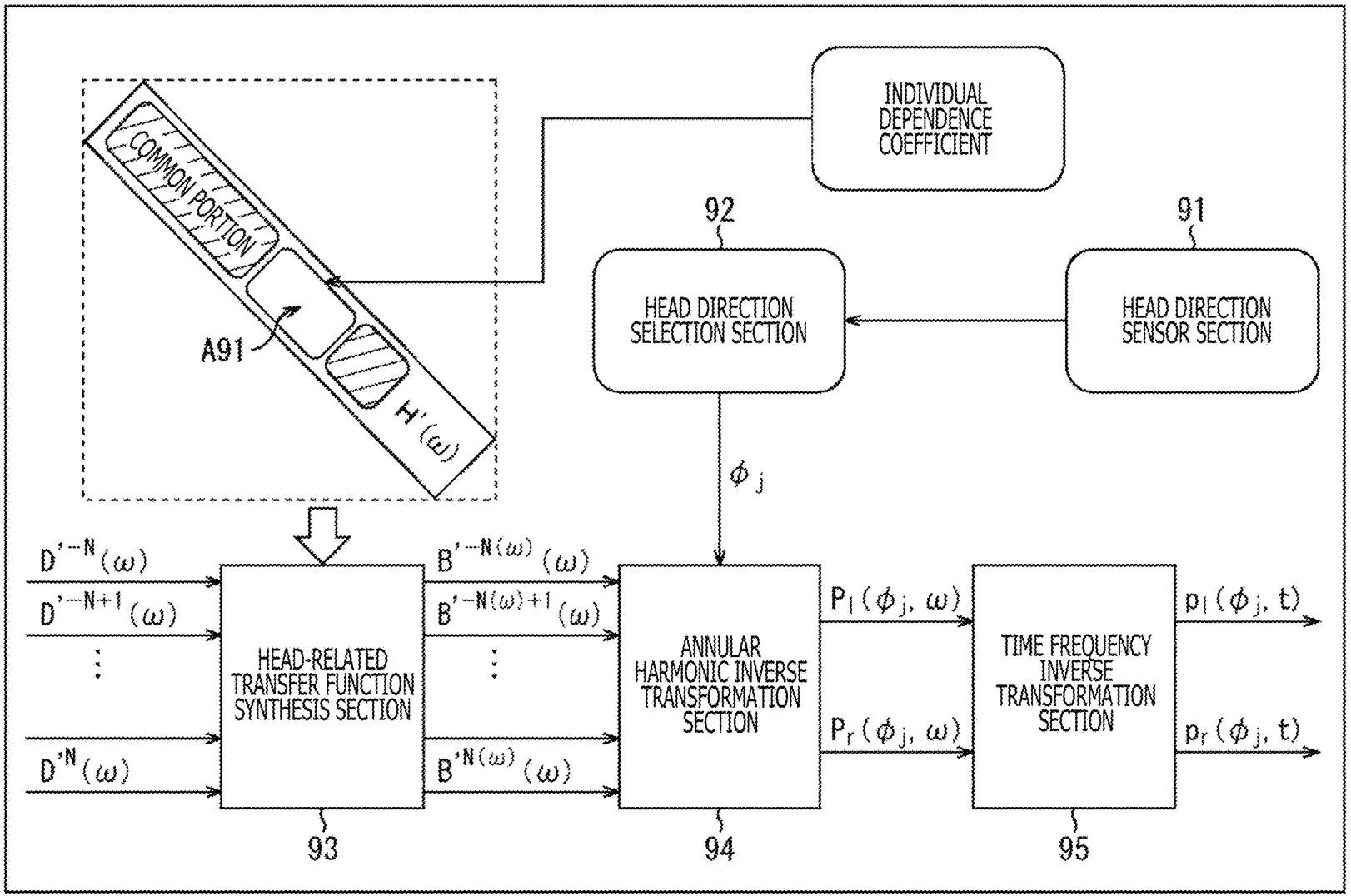
FIG. 12 is a diagram describing a generation of a matrix of the HRTF.

In a case in which the matrix $H'(\omega)$ is generated from the HRTF of the order that does not depend on the individual and the HRTF of the order that depends on the individual in this manner, the HRTF of the order that depends on the individual is acquired by some sort of method as illustrated in FIG. 12, for example, in the example of the audio processing apparatus 81 illustrated in FIG. 8. Note that in FIG. 12, the same sign as that of FIG. 8 is given to a portion corresponding to that of FIG. 8 and the descriptions are omitted arbitrarily.

In the example of FIG. 12, a rectangle in which the character "$H'(\omega)$" is written expresses the diagonal component of the matrix $H'(\omega)$ for the time frequency bin ω. A shaded portion of the diagonal component expresses a portion previously held in the audio processing apparatus 81, that is, a portion of the HRTF $H'^{m}(\omega)$ of the order that does not depend on the individual. In contrast, a portion indicated with an arrow A91 in the diagonal component expresses a portion of the HRTF $H'^{m}(\omega)$ of the order that depends on the individual.

In this example, the HRTF $H'^{m}(\omega)$ of the order that does not depend on the individual, which is expressed by the shaded portion of the diagonal component, is the HRTF used in common for all the users. In contrast, the HRTF $H'^{m}(\omega)$ of the order that depends on the individual, which is indicated by the arrow A91, is the different HRTF that varies depending on the individual user, such as the HRTF optimized for each individual user.

The audio processing apparatus 81 acquires from the outside the HRTF $H'^{m}(\omega)$ of the order that depends on the individual, which is expressed by a rectangle in which characters "individual dependence coefficient" are written. The audio processing apparatus 81 then generates the diagonal component of the matrix $H'(\omega)$ from the acquired HRTF $H'^{m}(\omega)$ and the previously held HRTF $H'^{m}(\omega)$ of the order that does not depend on the individual and supplies the diagonal component of the matrix $H'(\omega)$ to the HRTF synthesis section 93.

Meanwhile, here, there is described an example in which the matrix $H'(\omega)$ includes the HRTF used in common for all the users and the HRTF that varies depending on the user. However, the matrix $H'(\omega)$ may be a matrix in which all the elements that are not zero are different for different users. Further, the same matrix $H'(\omega)$ may be used in common for all the users.

Figure 13:
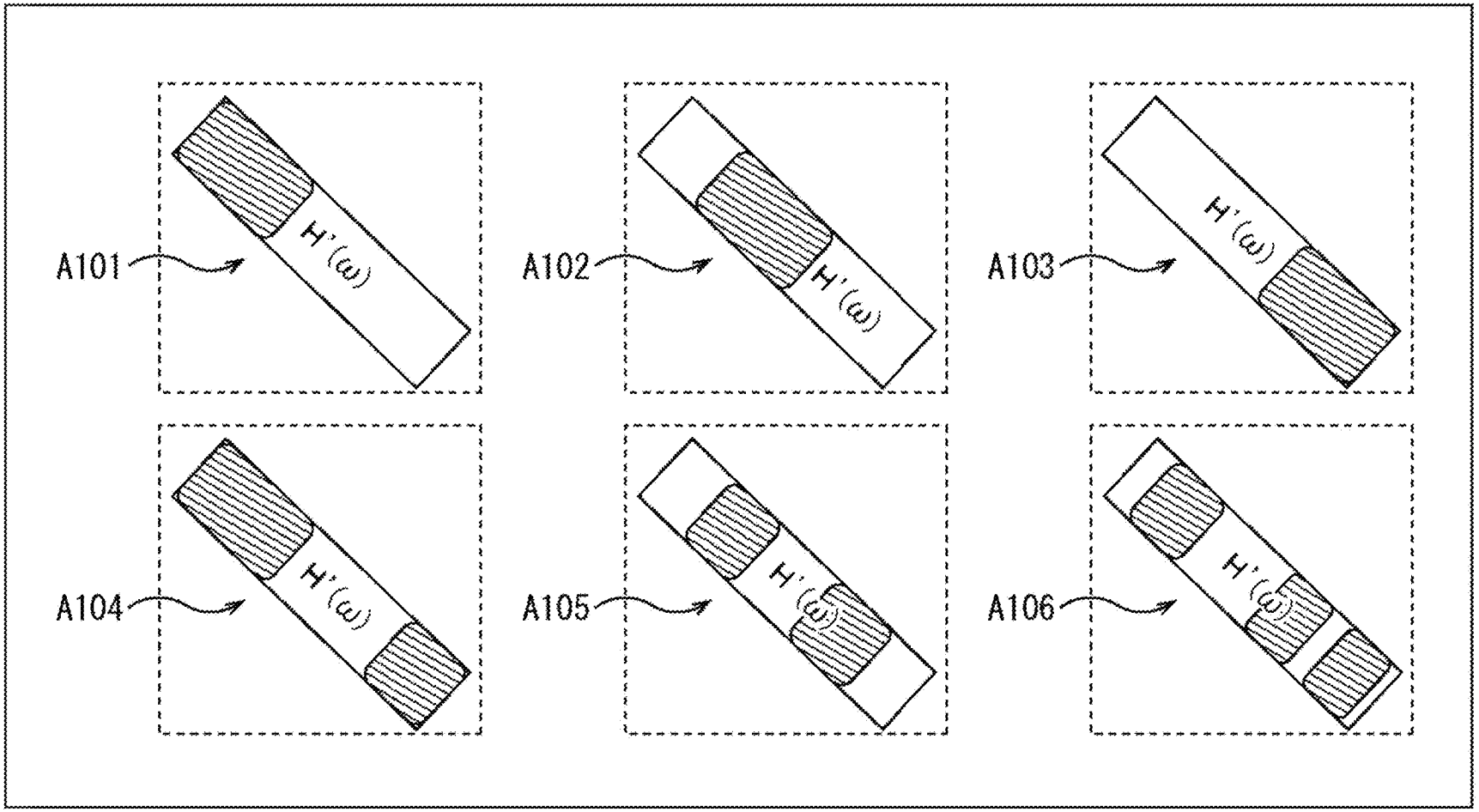
FIG. 13 is a diagram describing a reduction in the operation amount by the cutoff of the order.
Figure 14:
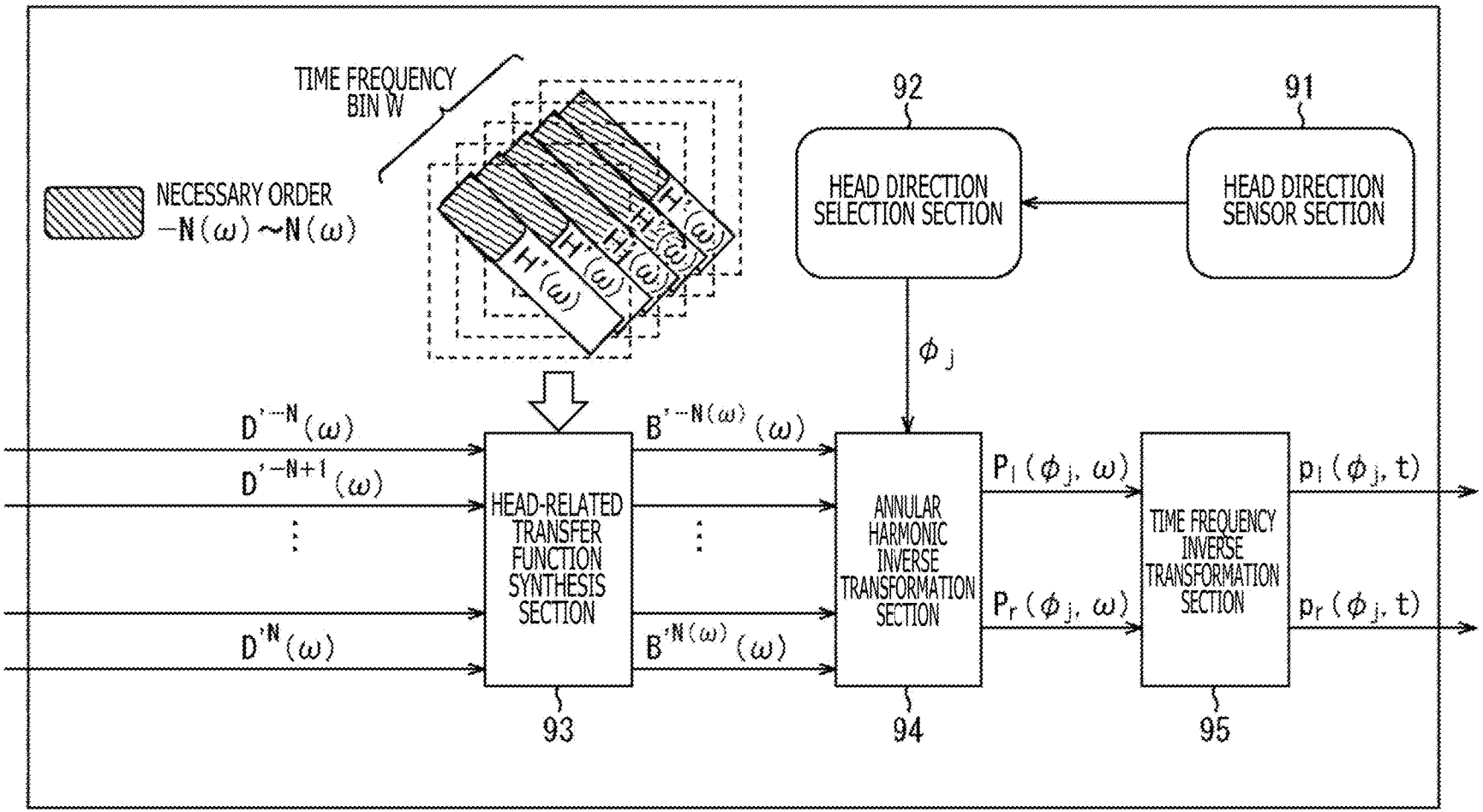
FIG. 14 is a diagram describing a reduction in the operation amount by the cutoff of the order.

Further, the generated matrix $H'(\omega)$ may include a different element for each time frequency bin ω as illustrated in FIG. 13 and an element for which the operation is performed may be different for each time frequency bin ω as illustrated in FIG. 14. Note that in FIG. 14, the same sign as that of FIG. 8 is given to a portion corresponding to that of FIG. 8 and the descriptions are omitted arbitrarily.

In FIG. 13, rectangles in which the character "$H'(\omega)$" is written expresses the diagonal components of the matrix $H'(\omega)$ of the predetermined time frequency bin ω, which are indicated by an arrow A101 to an arrow A106. In addition, the shaded portions of the above diagonal components express element parts of the necessary order m.

In an example indicated by each of the arrows A101 to A103, in the diagonal component of the matrix $H'(\omega)$, a part including elements adjacent to each other is an element part of the necessary order, and a position (domain) of the element part in the diagonal component is different among the examples.

In contrast, in an example indicated by each of the arrows A104 to A106, in the diagonal component of the matrix $H'(\omega)$, a plurality of parts including elements adjacent to each other are element parts of the necessary order. In the above examples, the number, positions, or sizes of the parts including elements required for the diagonal component are different among the examples.

Further, as illustrated in FIG. 14, the audio processing apparatus 81 has, as a database, information indicating the order m necessary for each time frequency bin ω at the same time, in addition to a database of the HRTF diagonalized by the annular harmonic function transformation, that is, the matrix $H'(\omega)$ of each time frequency bin ω.

In FIG. 14, the rectangle in which the character "$H'(\omega)$" is written expresses the diagonal component of the matrix $H'(\omega)$ for each time frequency bin ω held in the HRTF synthesis section 93. The shaded portions of the above diagonal components express the element parts of the necessary order m.

In this case, in the HRTF synthesis section 93, a product of the HRTF and the input signal $D'^{m}(\omega)$ is obtained, for example, for each time frequency bin ω, from the order $-N(\omega)$ to the order $m=N(\omega)$ necessary for the time frequency bin ω. In other words, the calculation of $H'^{m}(\omega)D'^{m}(\omega)$ in the above-described formula (22) is performed. This process permits the calculation of an unnecessary order to be reduced in the HRTF synthesis section 93.

<Configuration Example of Audio Processing Apparatus>

Figure 15:
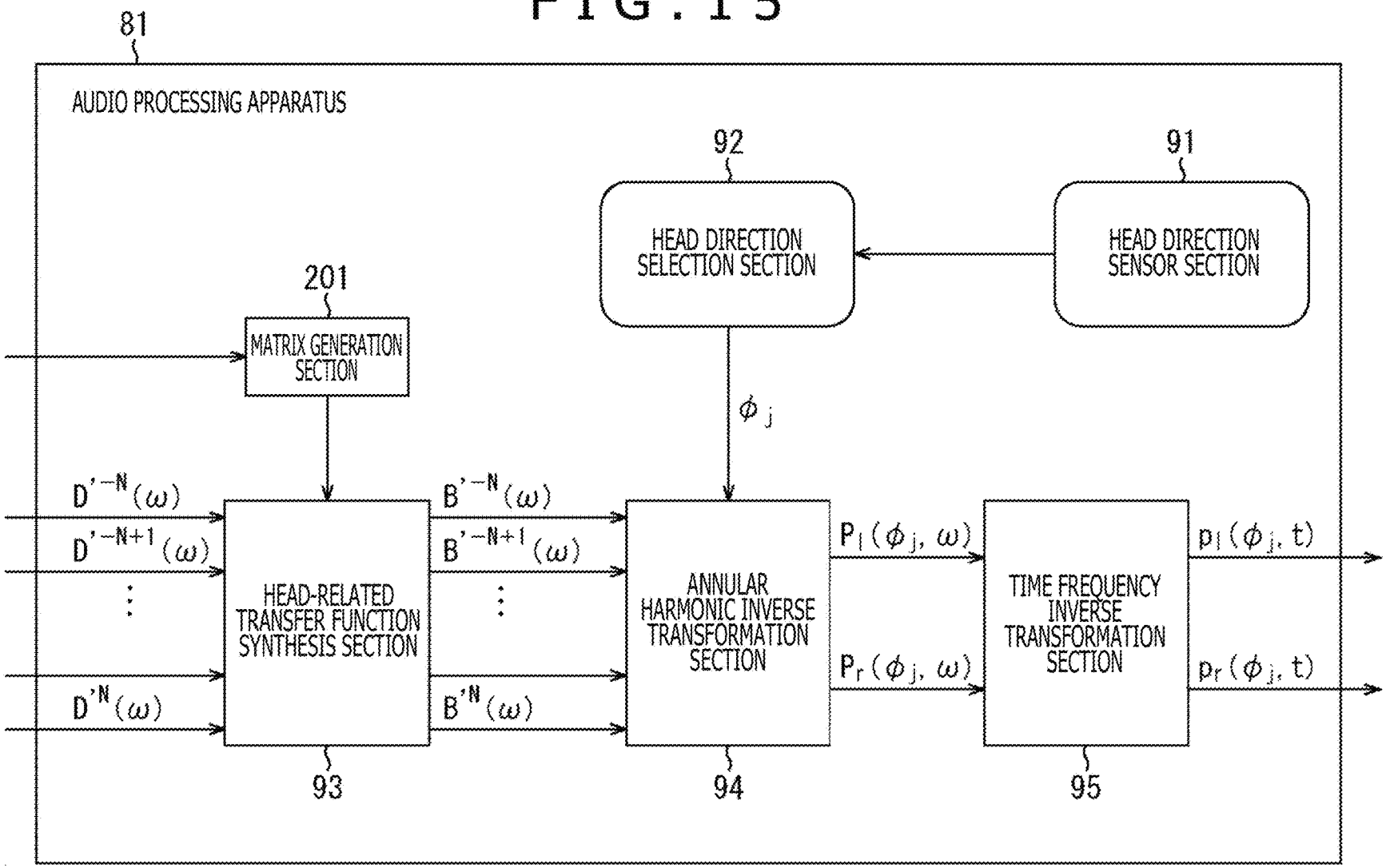
FIG. 15 is a diagram illustrating a configuration example of the audio processing apparatus to which the present technology is applied.

In a case of generating the matrix $H'(\omega)$, the audio processing apparatus 81 is configured, for example, as illustrated in FIG. 15. Note that in FIG. 15, the same sign as that of FIG. 8 is given to a portion corresponding to that of FIG. 8 and the descriptions are omitted arbitrarily.

The audio processing apparatus 81 illustrated in FIG. 15 includes the head direction sensor section 91, the head direction selection section 92, a matrix generation section 201, the HRTF synthesis section 93, the annular harmonic inverse transformation section 94, and the time frequency inverse transformation section 95.

The configuration of the audio processing apparatus 81 illustrated in FIG. 15 is a configuration in which the matrix generation section 201 is further formed in addition to the audio processing apparatus 81 illustrated in FIG. 8.

The matrix generation section 201 previously holds the HRTF of the order that does not depend on the individual and acquires from the outside the HRTF of the order that depends on the individual. The matrix generation section 201 generates the matrix H'(ω) from the acquired HRTF and the previously held HRTF of the order that does not depend on the individual and supplies the matrix H'(ω) to the HRTF synthesis section 93.

<Description of Driving Signal Generation Processing>

Figure 16:
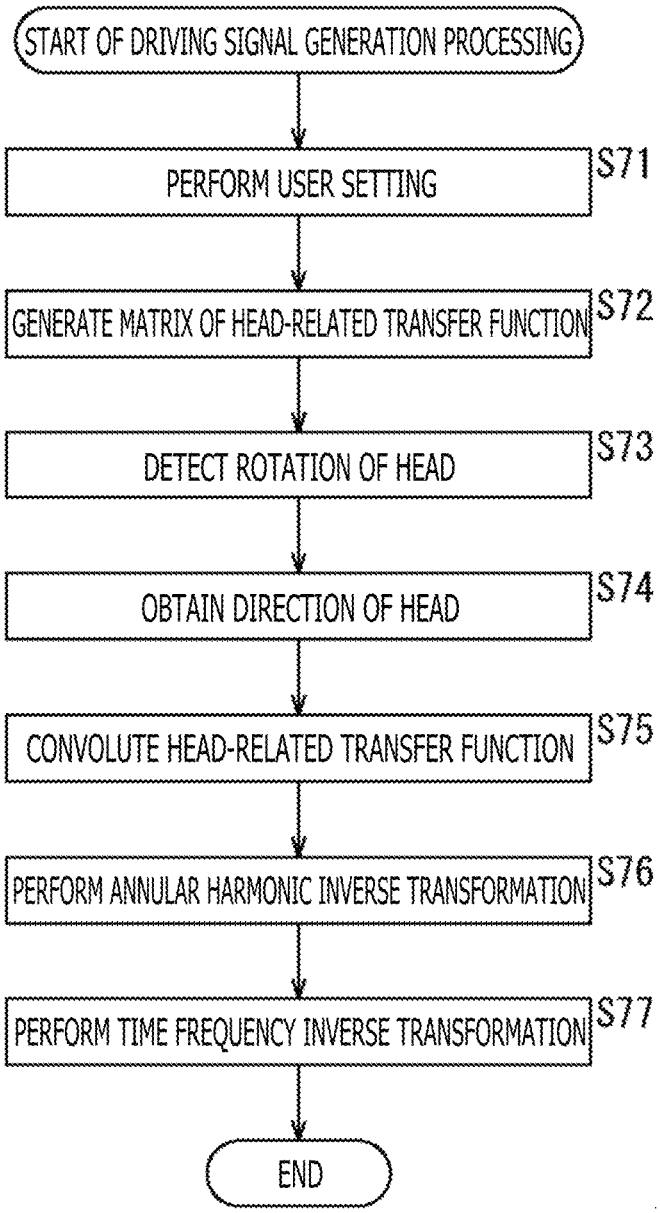
FIG. 16 is a flowchart describing the driving signal generation processing.

Subsequently, the driving signal generation processing performed by the audio processing apparatus 81 having the configuration illustrated in FIG. 15 will be described with reference to a flowchart of FIG. 16.

In step S71, the matrix generation section 201 performs user setting. In accordance with an input operation or the like by the user or the like, for example, the matrix generation section 201 performs the user setting for specifying information regarding the listener who listens to a sound to be reproduced this time.

Then, in accordance with the user setting, the matrix generation section 201 acquires the HRTF of the user of the order that depends on the individual regarding the listener who listens to a sound to be reproduced this time, that is, the user from the outside apparatuses or the like. Meanwhile, the HRTF of the user may be, for example, specified by the input operation by the user or the like at the time of the user setting or may be determined on the basis of the information determined by the user setting.

In step S72, the matrix generation section 201 generates the matrix H'(ω) of the HRTF and supplies the matrix H'(ω) of the HRTF to the HRTF synthesis section 93.

Specifically, when acquiring the HRTF of the order that depends on the individual, the matrix generation section 201 generates the matrix H'(ω) from the acquired HRTF and the previously held HRTF of the order that does not depend on the individual and supplies the matrix H'(ω) to the HRTF synthesis section 93. At this time, the matrix generation section 201 generates for each time frequency bin ω the matrix H'(ω) including only the elements of the necessary order on the basis of the information indicating the necessary order m for each of the previously held time frequency bins ω.

Then, the processes of step S73 to step S77 are performed and the driving signal generation processing ends. The above processes are similar to those of step S11 to step S15 of FIG. 9 and therefore the description is omitted. In the step S73 to the step S77, the HRTF is convoluted to the input signal in the annular harmonic domain and the driving signal of the headphones is generated. Note that the generation of the matrix H'(ω) may be previously performed or may be performed after the input signal is supplied.

As described above, the audio processing apparatus 81 convolutes the HRTF to the input signal in the annular harmonic domain and performs the annular harmonic inverse transformation on the convolution result to calculate the driving signals of the left and right headphones.

As described above, the convolution operation of the HRTF is performed in the annular harmonic domain and thereby the operation amount at the time of generating the driving signal of the headphones can be reduced substantially. At the same time, even the memory amount required at the operation can be reduced substantially. In other words, a sound can be reproduced more efficiently.

In particular, the audio processing apparatus 81 acquires the HRTF of the order that depends on the individual from the outside and generates the matrix H'(ω). Therefore, not only the memory amount can be further reduced but also the sound field can be reproduced appropriately by using the HRTF suitable for the individual user.

Meanwhile, here, there has been described an example in which a technology in which the HRTF of the order that depends on the individual is acquired from the outside and the matrix H'(ω) including only the elements of the necessary order is generated is applied to the audio processing apparatus 81. However, not limited to such an example, the unnecessary order need not be reduced.

<Target Input and HRTF Group>

Incidentally, in the above-described discussion, there is not taken into account what kind of plane virtual speakers are annularly arranged on with respect to the held HRTF and an initial head direction.

Figure 17:
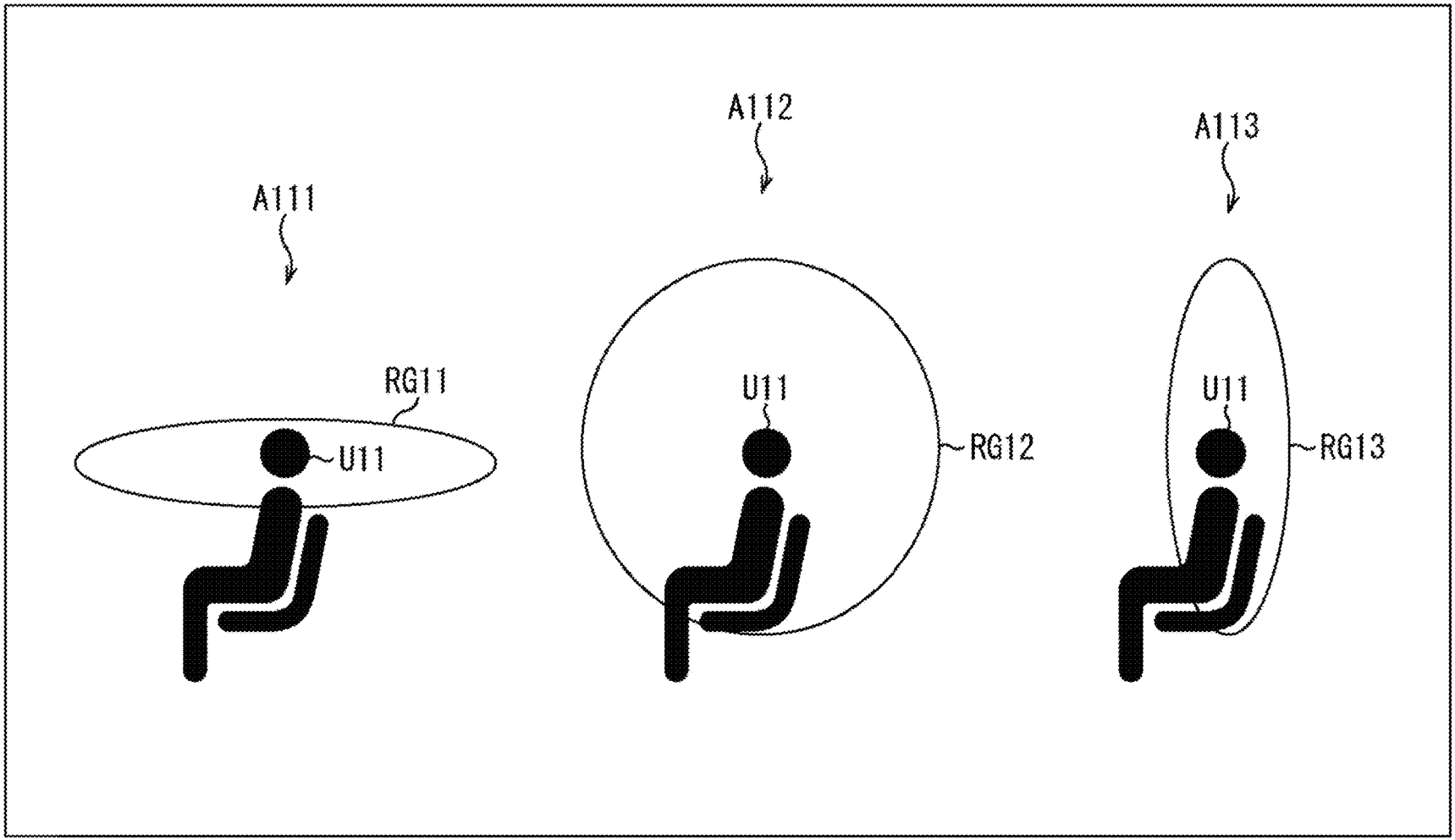
FIG. 17 is a diagram describing an arrangement of virtual speakers.

For example, the arrangement position of the virtual speakers with respect to the held HRTF and an initial head position may be on a horizontal plane as indicated with an arrow A111, on a median plane as indicated with an arrow A112, or on a coronary plane as indicated with an arrow A113 of FIG. 17. In other words, the virtual speakers may be arranged in any ring (hereinafter, referred to as a ring A) in which the center of the head of the listener is centered.

In an example indicated with the arrow A111, the virtual speakers are annularly arranged in a ring RG11 on the horizontal plane in which the head of a user U11 is centered. Further, in an example indicated with the arrow A112, the virtual speakers are annularly arranged in a ring RG12 on the median plane in which the head of the user U11 is centered, and in an example indicated with the arrow A113, the virtual speakers are annularly arranged in a ring RG13 on the coronary plane in which the head of the user U11 is centered.

Figure 18:
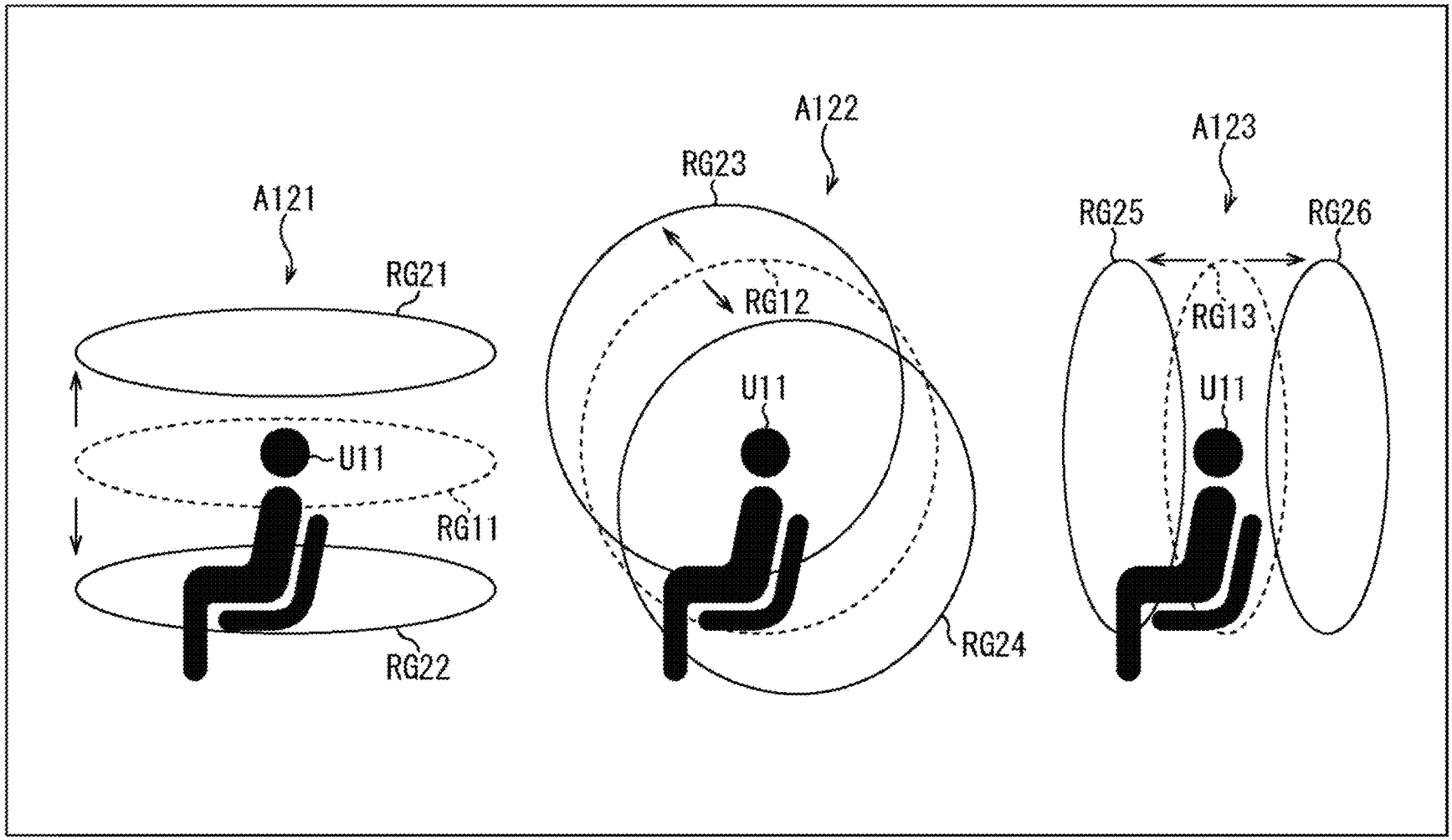
FIG. 18 is a diagram describing the arrangement of the virtual speakers.

Further, as illustrated in FIG. 18, for example, the arrangement position of the virtual speakers with respect to the held HRTF and the initial head direction may be set to a position in which a certain ring A is moved in a direction perpendicular to a plane in which the ring A is contained. Hereinafter, a ring obtained by moving such a ring A is referred to as a ring B. Note that in FIG. 18, the same sign as that of FIG. 17 is given to a portion corresponding to that of FIG. 17 and the descriptions are omitted arbitrarily.

In an example indicated with an arrow A121 of FIG. 18, the virtual speakers are annularly arranged in a ring RG21 or a ring RG22 obtained by moving the ring RG11 on the horizontal plane in which the head of the user U11 is centered in the vertical direction in the figure. In this example, the ring RG21 or the ring RG22 is the ring B.

Further, in an example indicated with an arrow A122, the virtual speakers are annularly arranged in a ring RG23 or a ring RG24 obtained by moving the ring RG12 on the median plane in which the head of the user U11 is centered in the depth direction in the figure. In an example indicated with an arrow A123, the virtual speakers are annularly arranged in a ring RG25 or a ring RG26 obtained by moving the ring RG13 on the coronary plane in which the head of the user U11 is centered in the horizontal direction in the figure.

Figure 19:
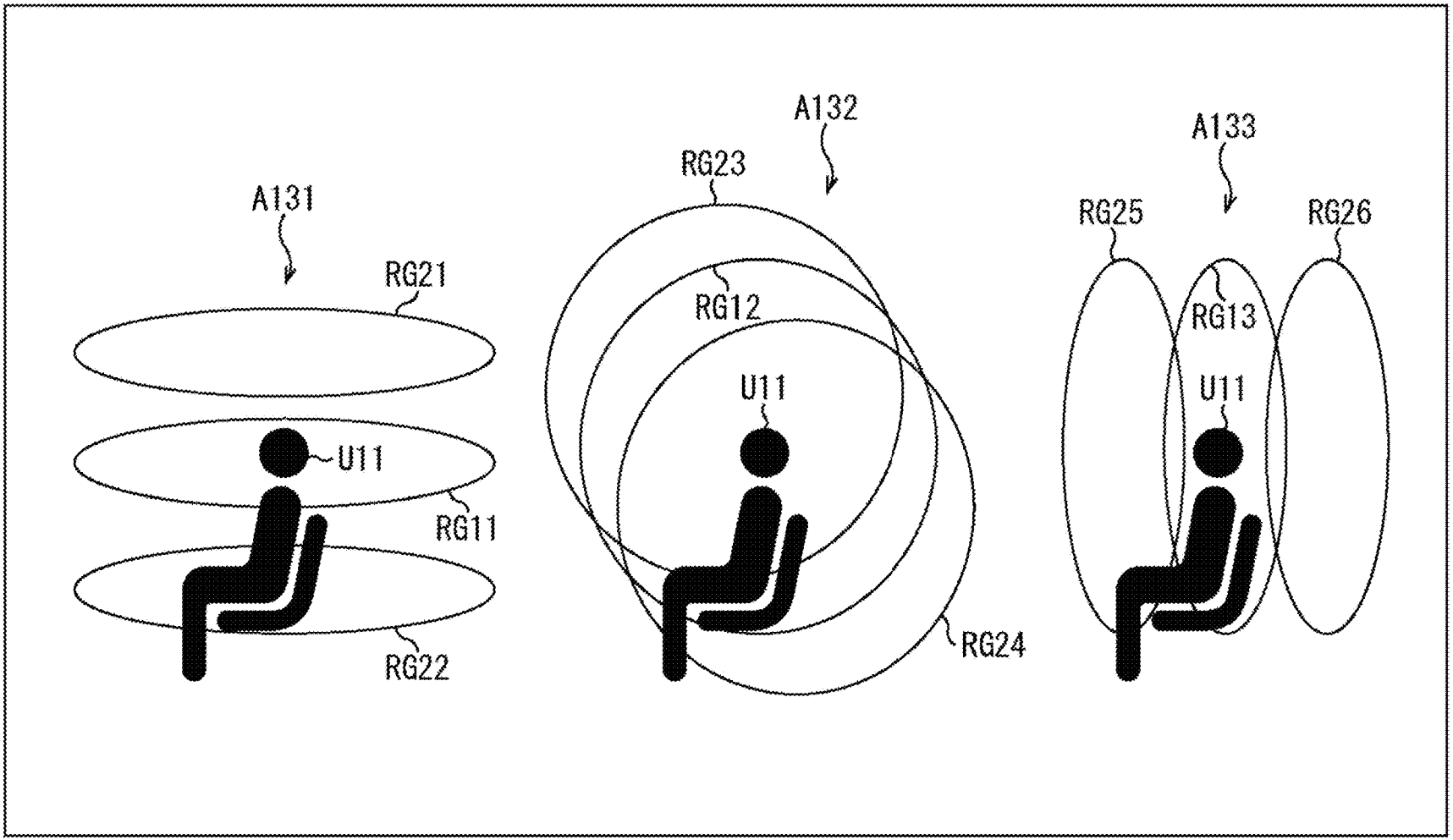
FIG. 19 is a diagram describing the arrangement of the virtual speakers.

Further, in the arrangement of the virtual speakers with respect to the held HRTF and the initial head direction, as illustrated in FIG. 19, in a case in which an input is received for each of a plurality of rings that array in a predetermined direction, the above-described system can be assembled in each ring. However, a unit that can be made common such as a sensor or headphones may be made common arbitrarily. Note that in FIG. 19, the same sign as that of FIG. 18 is given to a portion corresponding to that of FIG. 18 and the descriptions are omitted arbitrarily.

In the example indicated with an arrow A131 of FIG. 19, for example, the above-described system can be assembled in the ring RG11, the ring RG21, and the ring RG22 each that array in the vertical direction in the figure. Similarly, in the example indicated with an arrow A132, the above-described system can be assembled in the ring RG12, the ring RG23, and the ring RG24 each that array in the depth direction in the figure. In the example indicated with an arrow A133, the above-described system can be assembled in the ring RG13, the ring RG25, and the ring RG26 each that array in the horizontal direction in the figure.

Figure 20:
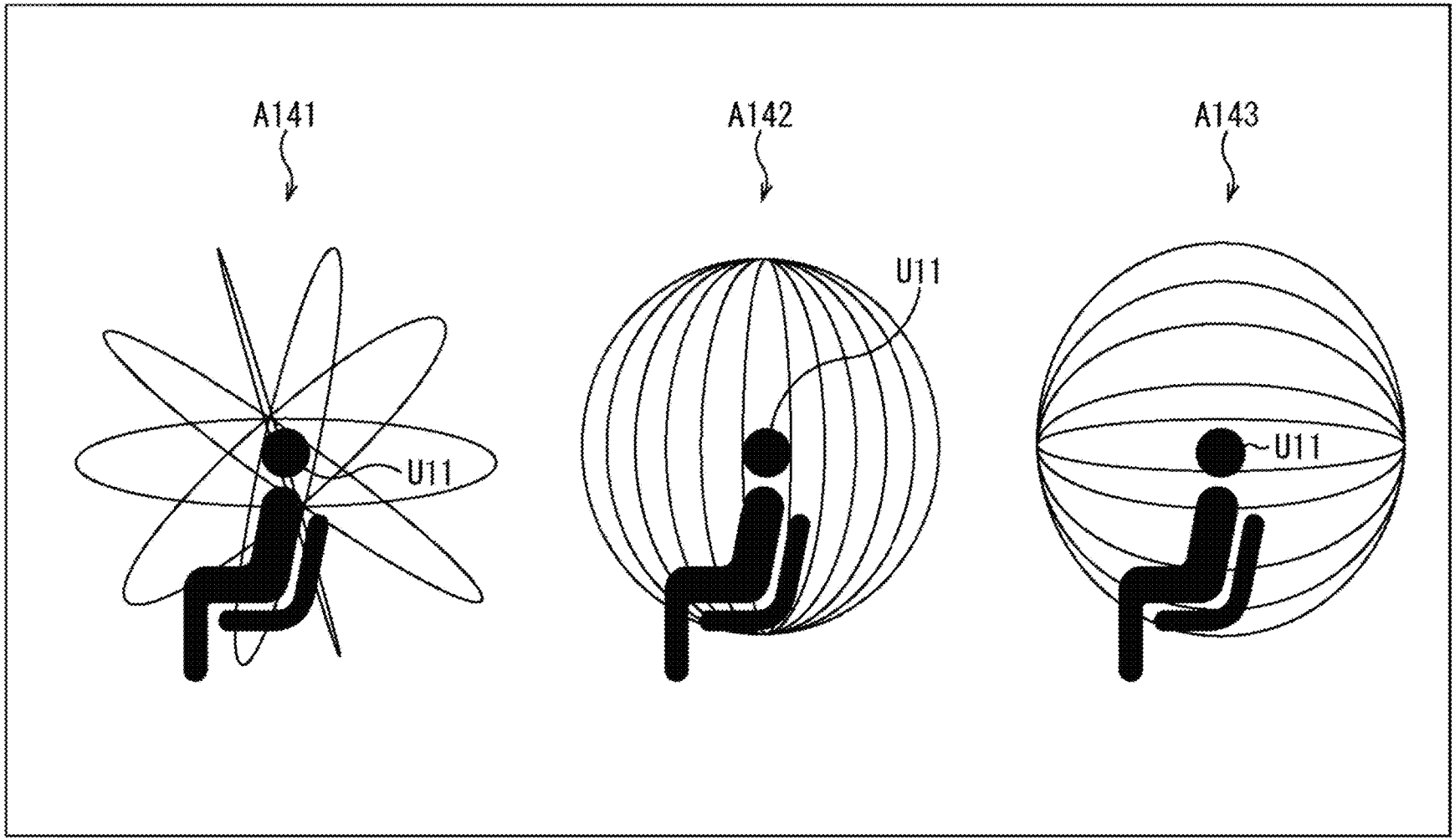
FIG. 20 is a diagram describing the arrangement of the virtual speakers.

Further, as illustrated in FIG. 20, in a group (hereinafter, referred to as a ring Adi) of the rings A having a plane including a certain straight line passing through the center of the head of the user U11 who is the listener, the matrix H'i(ω) of the diagonalized HRTF can be prepared in plurality. Note that in FIG. 20, the same sign as that of FIG. 19 is given to a portion corresponding to that of FIG. 19 and the descriptions are omitted arbitrarily.

In an example illustrated in FIG. 20, for example, in the examples indicated with an arrow A141 to an arrow A143, a plurality of circles around the head of the user U11 each express each ring Adi.

In this case, the matrix H'i(ω) of the HRTF is input to any of the ring Adi with respect to the initial head direction. According to a change in the head direction of the user, a process of selecting the matrix H'i(ω) of the optimal ring Adi is added to the above-described system.

<Configuration Example of Computer>

Incidentally, a series of processes described above can be executed by hardware or can be executed by software. When the series of processes are executed by the software, a program constituting the software is installed in a computer. Here, the computer includes a computer that is incorporated in dedicated hardware, a computer that can execute various functions by installing various programs, such as a general-purpose computer.

Figure 21:
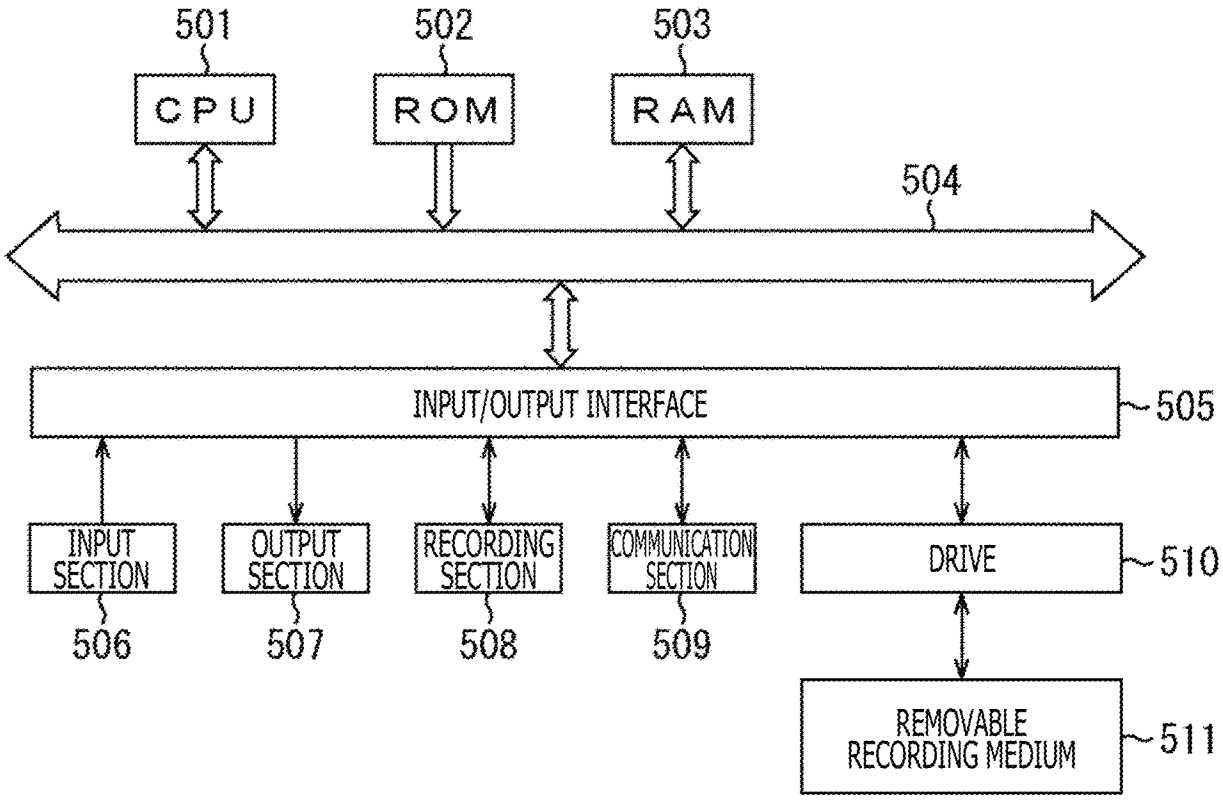
FIG. 21 is a diagram illustrating a configuration example of a computer.

FIG. 21 is a block diagram illustrating a configuration example of hardware of a computer for executing the series of processes described above with a program.

In the computer, a CPU (Central Processing Unit) 501, a ROM (Read Only Memory) 502, and a RAM (Random Access Memory) 503 are connected to one another via a bus 504.

An input/output interface 505 is further connected to the bus 504. An input section 506, an output section 507, a recording section 508, a communication section 509, and a drive 510 are connected to the input/output interface 505.

The input section 506 includes a keyboard, a mouse, a microphone, an image pickup device, and the like. The output section 507 includes a display, a speaker, and the like. The recording section 508 includes a hard disk, a nonvolatile memory, and the like. The communication section 509 includes a network interface and the like. The drive 510 drives a removable recording medium 511 such as a magnetic disk, an optical disk, a magneto-optical disk, or a semiconductor memory.

In the computer configured as described above, for example, the CPU 501 loads a program recorded in the recording section 508 via the input/output interface 505 and the bus 504 into the RAM 503 and executes the program to carry out the series of processes described above.

The program executed by the computer (CPU 501) can be provided by, for example, being recorded in the removable recording medium 511 as a packaged medium or the like. Further, the program can be provided via a wired or wireless transmission medium such as a local area network, the Internet, and a digital satellite broadcasting.

In the computer, the program can be installed in the recording section 508 via the input/output interface 505 by an action of inserting the removable recording medium 511 in the drive 510. Further, the program can be received by the communication section 509 via a wired or wireless transmission medium and installed in the recording section 508. Moreover, the program can be previously installed in the ROM 502 or the recording section 508.

It is to be noted that the program executed by the computer can be a program for which processes are performed in a chronological order along the sequence described in this specification or can be a program for which processes are performed in parallel or at necessary timings such as upon calling.

Further, embodiments of the present technology are not limited to the above-described embodiments, but various modifications may be made without departing from the gist of the present technology.

For example, the present technology can adopt a cloud computing configuration in which a single function is processed by a plurality of apparatuses via a network in a distributed and shared manner.

Moreover, each step described in the above-described flowcharts can be executed by a single apparatus or can be executed by a plurality of apparatuses in a distributed manner.

Further, when a single step includes a plurality of processes, the plurality of processes included in the single step can be executed by a single apparatus or can be executed by a plurality of apparatuses in a distributed manner.

Further, the advantageous effects described in this specification are strictly illustrative and are not limited thereto, and there may be advantageous effects other than those described in this specification.

Moreover, the present technology can adopt the following configurations.

(1)

An audio processing apparatus including:

a head-related transfer function synthesis section configured to synthesize an input signal in an annular harmonic domain or a portion of an input signal in a spherical harmonic domain corresponding to the annular harmonic domain and a diagonalized head-related transfer function; and an annular harmonic inverse transformation section configured to perform an annular harmonic inverse transformation on a signal obtained by the synthesis on the basis of an annular harmonic function to thereby generate a headphone driving signal in a time frequency domain.

(2)

The audio processing apparatus according to (1) above, in which the head-related transfer function synthesis section calculates a product of a diagonal matrix obtained by diagonalizing a matrix including a plurality of head-related transfer functions by an annular harmonic function transformation and a vector including the input signal corresponding to each order of the annular harmonic function and thereby synthesizes the input signal and the diagonalized head-related transfer function.

(3)

The audio processing apparatus according to (2) above, in which the head-related transfer function synthesis section synthesizes the input signal and the diagonalized head-related transfer function by using only an element of the predetermined order settable for each time frequency in a diagonal component of the diagonal matrix.

(4)

The audio processing apparatus according to (2) or (3) above, in which the diagonalized head-related transfer function used in common for users is included as an element in the diagonal matrix.

(5)

The audio processing apparatus according to any one of (2) to (4) above, in which the diagonalized head-related transfer function that depends on an individual user is included as an element in the diagonal matrix.

(6)

The audio processing apparatus according to (2) or (3) above, further including:

a matrix generation section configured to previously hold the diagonalized head-related transfer function that is common to users, the diagonalized head-related transfer function constituting the diagonal matrix, and acquires the diagonalized head-related transfer function that depends on an individual user to generate the diagonal matrix from the acquired diagonalized head-related transfer function and the previously held and diagonalized head-related transfer function.

(7)

The audio processing apparatus according to any one of (1) to (6) above, in which the annular harmonic inverse transformation section holds an annular harmonic function matrix including an annular harmonic function in each direction and performs the annular harmonic inverse transformation on the basis of a row corresponding to a predetermined direction of the annular harmonic function matrix.

(8)

The audio processing apparatus according to (7) above, further including:

a head direction acquisition section configured to acquire a direction of a head of a user who listens to a sound based on the headphone driving signal, in which the annular harmonic inverse transformation section performs the annular harmonic inverse transformation on the basis of a row corresponding to the direction of the head of the user in the annular harmonic function matrix.

(9)

The audio processing apparatus according to (8) above, further including:

a head direction sensor section configured to detect a rotation of the head of the user, in which the head direction acquisition section acquires a detection result by the head direction sensor section and thereby acquires the direction of the head of the user.

(10)

The audio processing apparatus according to any one of (1) to (9) above, further including:

a time frequency inverse transformation section configured to perform a time frequency inverse transformation on the headphone driving signal.

(11)

An audio processing method including the steps of:

synthesizing an input signal in an annular harmonic domain or a portion of an input signal in a spherical harmonic domain corresponding to the annular harmonic domain and a diagonalized head-related transfer function; and performing an annular harmonic inverse transformation on a signal obtained by the synthesis on the basis of an annular harmonic function to thereby generate a headphone driving signal in a time frequency domain.

(12)

A program for causing a computer to perform processing including the steps of:

synthesizing an input signal in an annular harmonic domain or a portion of an input signal in a spherical harmonic domain corresponding to the annular harmonic domain and a diagonalized head-related transfer function; and performing an annular harmonic inverse transformation on a signal obtained by the synthesis on the basis of an annular harmonic function to thereby generate a headphone driving signal in a time frequency domain.

REFERENCE SIGNS LIST

81 Audio processing apparatus, 91 Head direction sensor section, 92 Head direction selection section, 93 Head-related transfer function synthesis section, 94 Annular harmonic inverse transformation section, 95 Time frequency inverse transformation section, 201 Matrix generation section

The invention claimed is:

1. An audio processing apparatus comprising:

a head-related transfer function synthesis section configured to synthesize an input signal in an annular harmonic domain or a portion of an input signal in a spherical harmonic domain corresponding to the annular harmonic domain and a diagonalized head-related transfer function; and an annular harmonic inverse transformation section configured to perform an annular harmonic inverse transformation on a signal obtained by the synthesis on a basis of an annular harmonic function to thereby generate a headphone driving signal in a time frequency domain.

2. The audio processing apparatus according to claim 1, wherein the head-related transfer function synthesis section calculates a product of a diagonal matrix obtained by diagonalizing a matrix including a plurality of head-related transfer functions by an annular harmonic function transformation and a vector including the input signal corresponding to each order of the annular harmonic function and thereby synthesizes the input signal and the diagonalized head-related transfer function.

3. The audio processing apparatus according to claim 2, wherein the head-related transfer function synthesis section synthesizes the input signal and the diagonalized head-related transfer function by using only an element of the predetermined order settable for each time frequency in a diagonal component of the diagonal matrix.

4. The audio processing apparatus according to claim 2, wherein the diagonalized head-related transfer function used in common for users is included as an element in the diagonal matrix.

5. The audio processing apparatus according to claim 2, wherein the diagonalized head-related transfer function that depends on an individual user is included as an element in the diagonal matrix.

6. The audio processing apparatus according to claim 2, further comprising:

a matrix generation section configured to previously hold the diagonalized head-related transfer function that is common to users, the diagonalized head-related transfer function constituting the diagonal matrix, and acquires the diagonalized head-related transfer function that depends on an individual user to generate the diagonal matrix from the acquired diagonalized head-related transfer function and the previously held and diagonalized head-related transfer function.

7. The audio processing apparatus according to claim 1, wherein the annular harmonic inverse transformation section holds an annular harmonic function matrix including an annular harmonic function in each direction and performs the annular harmonic inverse transformation on a basis of a row corresponding to a predetermined direction of the annular harmonic function matrix.

8. The audio processing apparatus according to claim 7, further comprising:

a head direction acquisition section configured to acquire a direction of a head of a user who listens to a sound based on the headphone driving signal, wherein the annular harmonic inverse transformation section performs the annular harmonic inverse transformation on a basis of a row corresponding to the direction of the head of the user in the annular harmonic function matrix.

9. The audio processing apparatus according to claim 8, further comprising:

a head direction sensor section configured to detect a rotation of the head of the user, wherein the head direction acquisition section acquires a detection result by the head direction sensor section and thereby acquires the direction of the head of the user.

10. The audio processing apparatus according to claim 1, further comprising:

a time frequency inverse transformation section configured to perform a time frequency inverse transformation on the headphone driving signal.

11. An audio processing method comprising:

synthesizing an input signal in an annular harmonic domain or a portion of an input signal in a spherical harmonic domain corresponding to the annular harmonic domain and a diagonalized head-related transfer function; and performing an annular harmonic inverse transformation on a signal obtained by the synthesis on a basis of an annular harmonic function to thereby generate a headphone driving signal in a time frequency domain.

12. A non-transitory computer-readable medium storing instructions that, when executed by a processing device, perform a method comprising:

synthesizing an input signal in an annular harmonic domain or a portion of an input signal in a spherical harmonic domain corresponding to the annular harmonic domain and a diagonalized head-related transfer function; and performing an annular harmonic inverse transformation on a signal obtained by the synthesis on a basis of an annular harmonic function to thereby generate a headphone driving signal in a time frequency domain.

* * * * *